US011538617B2

(12) United States Patent
Bharath et al.

(10) Patent No.: US 11,538,617 B2
(45) Date of Patent: Dec. 27, 2022

(54) INTEGRATED MAGNETIC CORE INDUCTORS ON GLASS CORE SUBSTRATES

(71) Applicant: Intel Corporation, Santa Clara, CA (US)

(72) Inventors: Krishna Bharath, Chandler, AZ (US); Adel Elsherbini, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 955 days.

(21) Appl. No.: 16/024,593

(22) Filed: Jun. 29, 2018

(65) Prior Publication Data

US 2020/0005989 A1 Jan. 2, 2020

(51) Int. Cl.

| | |
|---|---|
| ***H01F 5/00*** | (2006.01) |
| ***H01F 27/28*** | (2006.01) |
| ***H01F 41/04*** | (2006.01) |
| ***H01F 41/02*** | (2006.01) |
| ***H01F 27/24*** | (2006.01) |

(52) U.S. Cl.

CPC ..... *H01F 27/2804* (2013.01); *H01F 27/24* (2013.01); *H01F 41/0206* (2013.01); *H01F 41/041* (2013.01)

(58) Field of Classification Search

CPC ..... H01F 27/2804
USPC ..... 336/200
See application file for complete search history.

(56) References Cited

U.S. PATENT DOCUMENTS

| | | | | |
|---|---|---|---|---|
| 6,525,901 | B1 * | 2/2003 | Kamijima | G11B 5/3967 360/123.41 |
| 9,807,882 | B1 * | 10/2017 | Berdy | H01L 23/5227 |
| 2005/0157432 | A1 * | 7/2005 | Hsiao | G11B 5/3133 360/122 |
| 2006/0065620 | A1 * | 3/2006 | Lee | G11B 5/3163 360/110 |
| 2006/0170071 | A1 * | 8/2006 | Imaoka | H01L 23/49822 257/E23.07 |
| 2010/0098960 | A1 * | 4/2010 | Dominguez | H01L 28/10 427/97.1 |
| 2011/0302771 | A1 | 12/2011 | Aleksov et al. | |
| 2014/0177189 | A1 * | 6/2014 | Liu | H01L 23/5223 361/803 |
| 2014/0268615 | A1 | 9/2014 | Yun et al. | |
| 2014/0353019 | A1 * | 12/2014 | Arora | H05K 3/0035 156/247 |

(Continued)

OTHER PUBLICATIONS

International Preliminary Report on Patentability for PCT Application No. PCT/US2019/034113, dated Jan. 7, 2021.

(Continued)

*Primary Examiner* — Ronald Hinson
(74) *Attorney, Agent, or Firm* — Essential Patents Group, LLP.

(57) ABSTRACT

A microelectronics package comprising a package core and an inductor over the package core. The inductor comprises a dielectric over the package core. The dielectric comprises a curved surface opposite the package core. At least one conductive trace is adjacent to the package core. The at least one conductive trace is at least partially embedded within the dielectric and extends over the package core. A magnetic core cladding is over the dielectric layer and at least partially surrounding the conductive trace.

18 Claims, 11 Drawing Sheets

(56) References Cited

U.S. PATENT DOCUMENTS

| | | | | |
|---|---|---|---|---|
| 2015/0077209 | A1* | 3/2015 | Fujii | H01F 17/0006 336/200 |
| 2015/0340422 | A1 | 11/2015 | Lee et al. | |
| 2017/0062398 | A1 | 3/2017 | Arabi et al. | |
| 2018/0366442 | A1* | 12/2018 | Gu | H01L 24/14 |

OTHER PUBLICATIONS

International Search Report and Written Opinion for PCT Application No. PCT/US19/34113, dated Sep. 17, 2019.

* cited by examiner

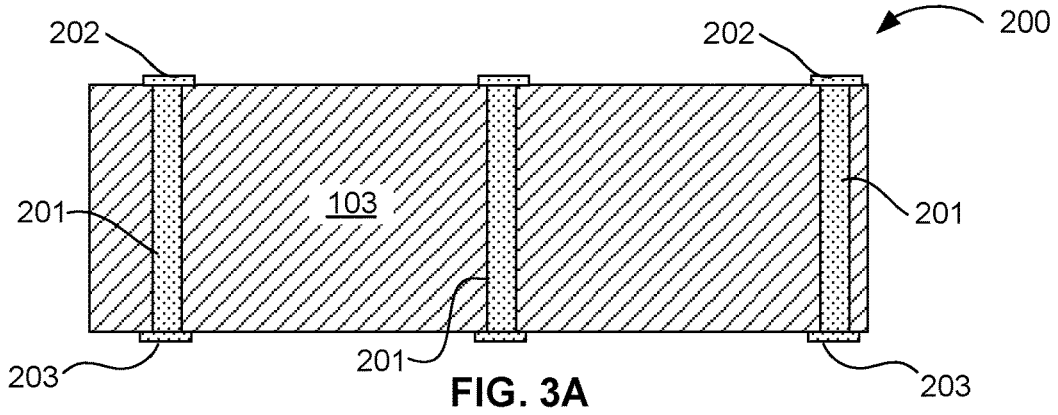
FIG. 3A
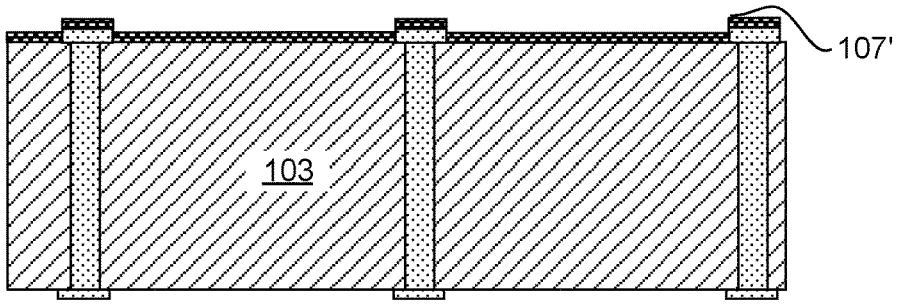
FIG. 3B
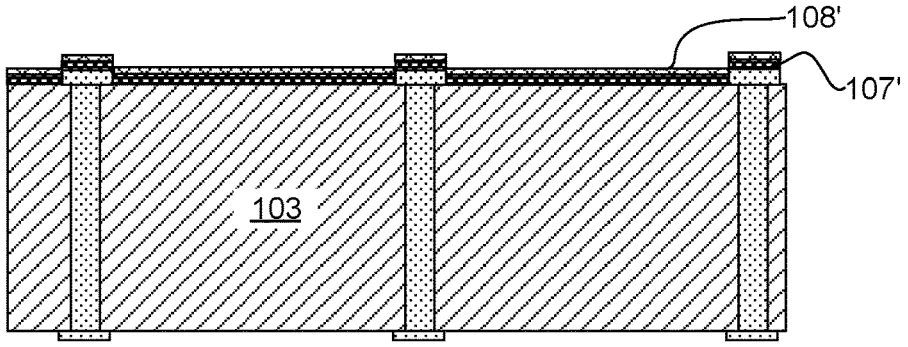
FIG. 3C
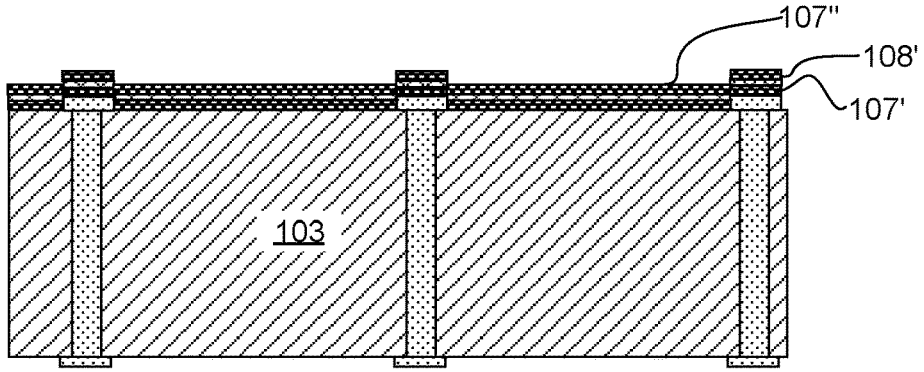
FIG. 3D
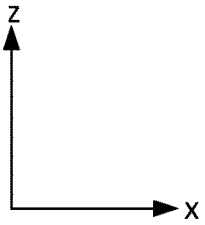

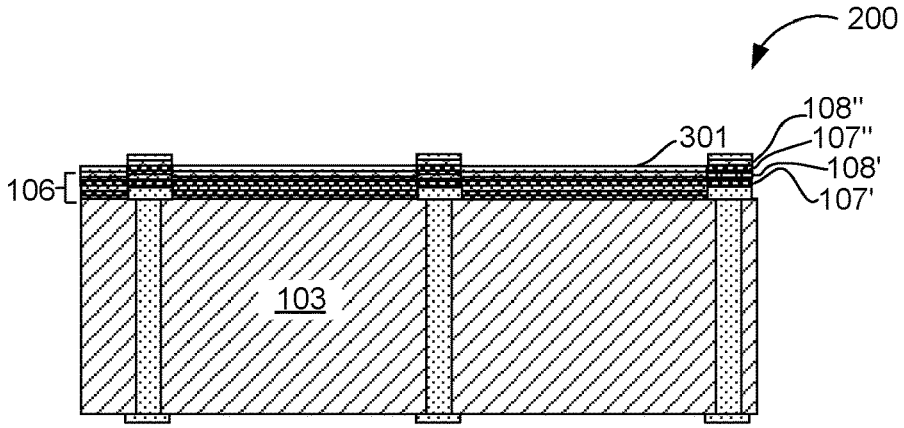
FIG. 3E
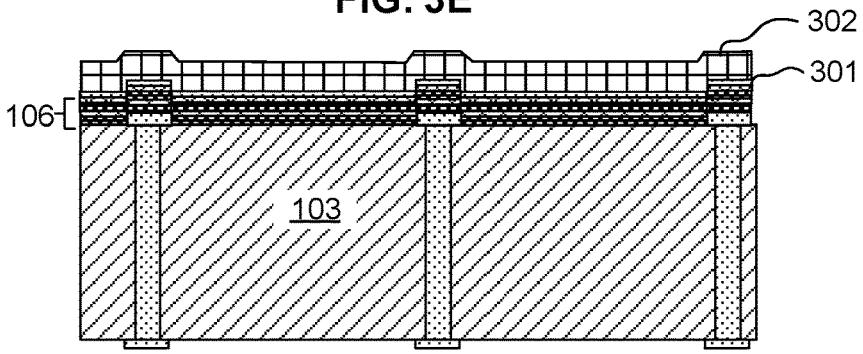
FIG. 3F
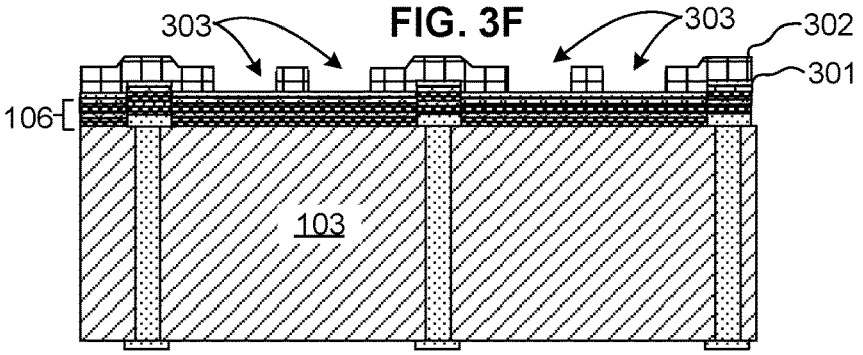
FIG. 3G
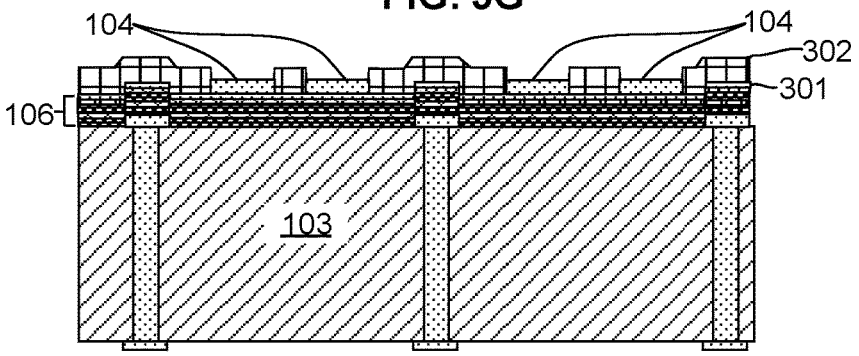
FIG. 3H
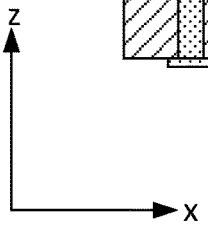

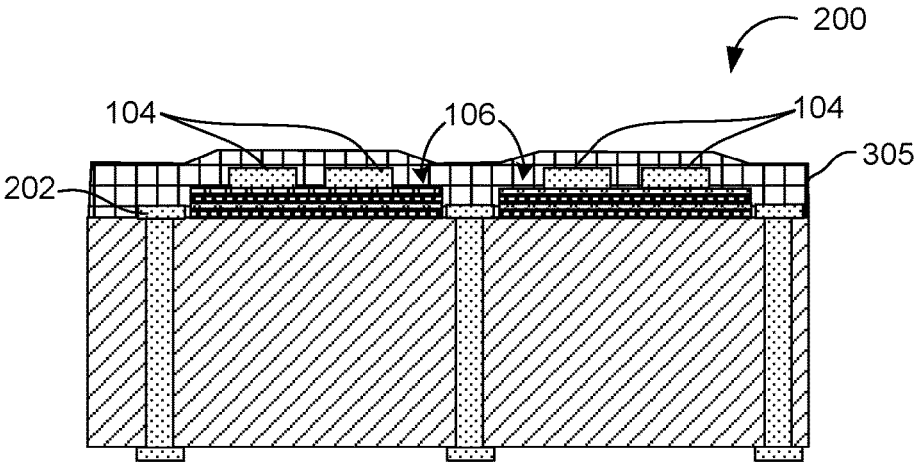
FIG. 3M
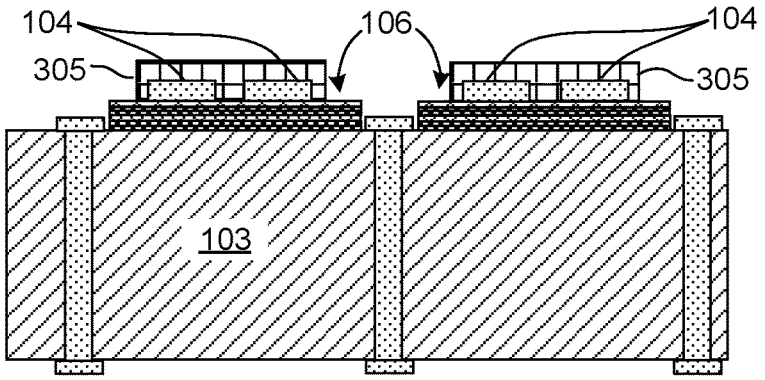
FIG. 3N
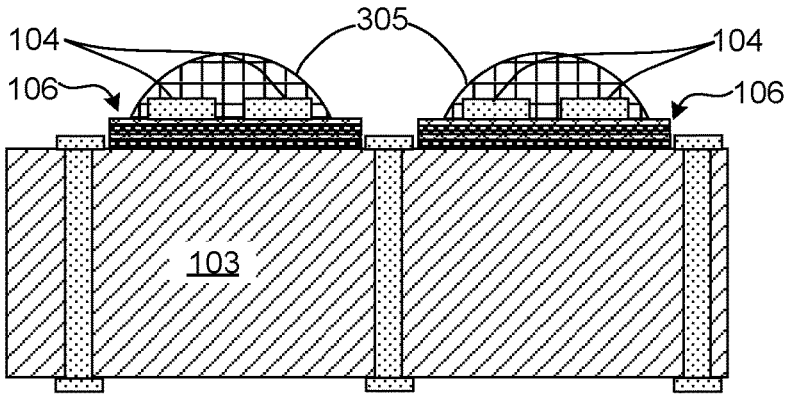
FIG. 3O
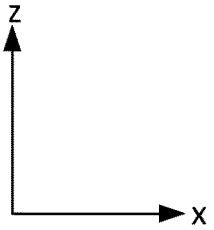

INTEGRATED MAGNETIC CORE INDUCTORS ON GLASS CORE SUBSTRATES

BACKGROUND

Integrated voltage regulator (IVR) technology is an efficient die and package architecture for managing disparate voltages required by the various functions encompassed by a microprocessor. Currently, IVR implementations in microprocessor packages, such as fully-integrated voltage regulator (FIVR) topologies, rely on air-core inductors. Typically, the air-core inductors are off-die, either on, or embedded within, the package dielectric adjacent to the microprocessor die. Industry trends and market pressures are forcing chip manufacturers to reduce package footprint with succeeding microprocessor generations. Space for the embedded inductor is reduced as well, causing decreases in inductor performance. In particular, the successively more compact air-core inductors have inductances that diminish from generation to generation, resulting in declining quality factor (ratio of energy stored in the inductor's magnetic field to energy dissipated by resistive losses in the inductor windings). As a consequence, the overall efficiency of IVRs suffer as losses increase.

BRIEF DESCRIPTION OF THE DRAWINGS

The embodiments of the disclosure will be understood more fully from the detailed description given below and from the accompanying drawings of various embodiments of the disclosure, which, however, should not be taken to limit the disclosure to the specific embodiments, but are for explanation and understanding only.

DETAILED DESCRIPTION

Figure 1A:
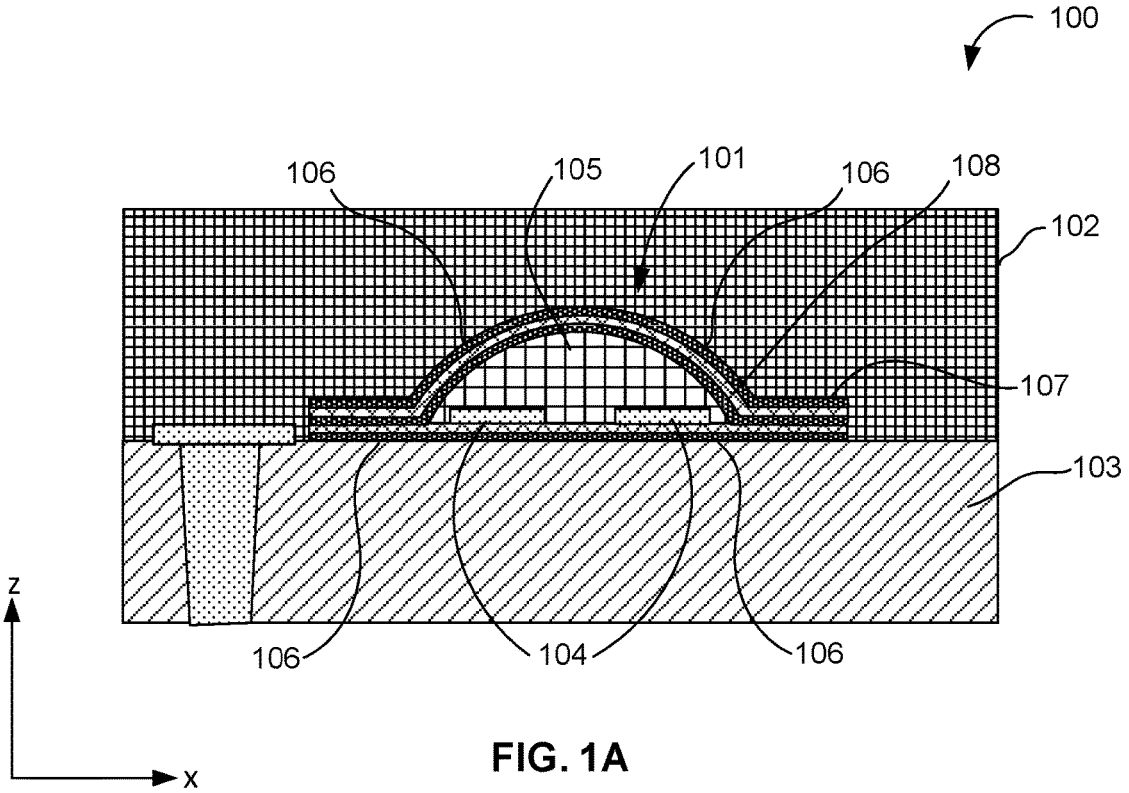
FIG. 1A illustrates a cross-sectional view of an integrated inductor on a package substrate core, according to some embodiments of the disclosure.

In the following description, numerous details are discussed to provide a more thorough explanation of embodiments of the present disclosure. It will be apparent, however, to one skilled in the art, that embodiments of the present disclosure may be practiced without these specific details. In other instances, well-known structures and devices are shown in block diagram form, rather than in detail, in order to avoid obscuring embodiments of the present disclosure.

Throughout the specification, and in the claims, the term "connected" or "interconnected" means a direct connection, such as electrical, mechanical, or magnetic connection between the things that are connected, without any intermediary devices.

Here, the term "coupled" means a direct or indirect connection, such as a direct electrical, mechanical, or magnetic connection between the things that are connected or an indirect connection, through one or more passive or active intermediary devices.

Here, the term "package" generally refers to a self-contained carrier of one or more dies, where the dies are attached to the package substrate, and encapsulated for protection, with integrated or wire-boned interconnects between the die(s) and leads, pins or bumps located on the external portions of the package substrate. The package may contain a single die, or multiple dies, providing a specific function. The package is usually mounted on a printed circuit board for interconnection with other packaged ICs and discrete components, forming a larger circuit.

Here, the term "substrate" refers to the substrate of an IC package. The package substrate is generally coupled to the die or dies contained within the package, where the substrate comprises a dielectric having conductive structures on or embedded with the dielectric. Throughout this specification, the term "package substrate" is used to refer to the substrate of an IC package.

Here, the term "core" generally refers to a stiffening layer generally embedded within of the package substrate, or comprising the base of a package substrate. In many IC package architectures, a core may or may not be present within the package substrate. A package substrate comprising a core is referred to as a "cored substrate". A package substrate is generally referred to as a "coreless substrate". The core may comprise a dielectric organic or inorganic material, and may have conductive vias extending through the body of the core.

The term "circuit" or "module" may refer to one or more passive and/or active components that are arranged to cooperate with one another to provide a desired function. The term "signal" may refer to at least one current signal, voltage signal, magnetic signal, or data/clock signal. The meaning of "a," "an," and "the" include plural references. The meaning of "in" includes "in" and "on."

The term "microprocessor" generally refers to an integrated circuit (IC) package comprising a central processing unit (CPU) or microcontroller. The microprocessor package may comprise a land grid array (LGA) of electrical contacts, and an integrated heat spreader (IHS). The microprocessor package is referred to as a "microprocessor" in this disclosure. A microprocessor socket receives the microprocessor and couples it electrically to the PCB.

The vertical orientation is in the z-direction and it is understood that recitations of "top", "bottom", "above" and "below" refer to relative positions in the z-dimension with the usual meaning. However, it is understood that embodiments are not necessarily limited to the orientations or configurations illustrated in the figure.

The terms "substantially," "close," "approximately," "near," and "about," generally refer to being within +/−10% of a target value (unless specifically specified). Unless otherwise specified the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner.

For the purposes of the present disclosure, phrases "A and/or B" and "A or B" mean (A), (B), or (A and B). For the purposes of the present disclosure, the phrase "A, B, and/or C" means (A), (B), (C), (A and B), (A and C), (B and C), or (A, B and C).

Views labeled "cross-sectional", "profile", "plan", and "isometric" correspond to orthogonal planes within a cartesian coordinate system. Thus, cross-sectional and profile views are taken in the x-z plane, plan views are taken in the x-y plane, and isometric views are taken in a 3-dimensional cartesian coordinate system (x-y-z). Where appropriate, drawings are labeled with axes to indicate the orientation of the figure.

FIG. 1A illustrates a cross-sectional view of an integrated inductor 101 on a package substrate core 103, according to some embodiments of the disclosure.

In FIG. 1A, a cross section of cored-package substrate 100 is illustrated, showing a cross-sectional view of integrated magnetic core inductor 101, embedded within dielectric 102 and supported on package substrate core 103. Integrated magnetic core inductor 101 comprises one or more adjacent (if two or more) inductor traces 104 embedded within dielectric 105, which, within the z-x plane, is surrounded by magnetic core cladding 106. In some embodiments, magnetic core cladding 106 is a contiguous structure extending over and enclosing the convex portion of dielectric 105, and extending under dielectric 105. In some alternative embodiments, magnetic core cladding only partially surrounds dielectric 105 within the z-x plane (e.g., see FIG. 1C).

In some embodiments, package substrate core 103 comprises a smooth surface, having an average surface roughness significantly less than is typical of conventional core materials (e.g., organic material cores). For example, package substrate core 103 may have an average surface roughness of 100 nm, or less. In some embodiments, package substrate core 103 comprises a amorphous material comprising materials such as, but not limited to, fused silica, a borosilicate glass, or a soda-lime glass. In some alternative embodiments, package substrate core 103 comprises a crystalline material, such as, but not limited to, single crystal silicon, silicon nitride, or aluminum oxide (e.g., sapphire). In some crystalline core embodiments, package substrate core 103 is a silicon wafer having at least one polished surface. In some embodiments, package substrate core 103 has a thickness in the range of 100 to 500 microns.

In some embodiments, magnetic cladding 106 is a multilayer stack of films comprising alternating layers of magnetic film layer 107 and dielectric film layer 108. In some embodiments, magnetic film layer 107 comprises electrically conductive ferromagnetic metals such as, but not restricted to, iron, nickel, nickel-iron alloys such as Mu metals and permalloys. In some embodiments, magnetic film 107 comprises lanthanide or actinide elements. In some embodiments, magnetic film 107 comprises cobalt-zirconium-tantalum alloy (e.g., CZT). Magnetic film 107 may also comprise semiconducting or semi-metallic Heusler compounds and non-conducting (ceramic) ferrites. In some embodiments, ferrite materials comprise any of nickel, manganese, zinc, and/or cobalt constituents in addition to iron. In some embodiments, ferrite materials comprise barium and/or strontium. Heusler compounds may comprise any of manganese, iron, cobalt, molybdenum, nickel, copper, vanadium, indium, aluminum, gallium, silicon, germanium, tin, and/or antimony.

In some embodiments, dielectric film layer 108 comprises one or more non-magnetic dielectric materials such as, but not limited to, oxides of silicon, aluminum, titanium, tantalum and/or molybdenum, silicon carbide, silicon nitrides, silicon oxynitrides, and/or aluminum nitrides. In some embodiments, dielectric film comprises ferrimagnetic non-conductive materials such as, but not limited to, ceramic ferrites, as mentioned above.

The layered structure of magnetic core cladding 106 comprises a stack of alternating magnetic and non-magnetic dielectric layers, embodied by alternating layers comprising magnetic film 107 and dielectric film 108. In some embodiments, magnetic film layer 107 and dielectric film layer 108 have thicknesses ranging between 50 nm to 200 nm. In some embodiments, magnetic film layer 107 comprises an electrically conductive material, such as the electrically conductive materials listed above. In this case, the layered structure of magnetic core cladding 106 reduces eddy current losses by confining the eddy currents within thin conductive layers (e.g., magnetic film 107). In some embodiments, magnetic core cladding 106 comprises multiple alternating layers ranging between two to 10 interleaved layers of magnetic film 107 and dielectric film 108. In some embodiments, magnetic core cladding 106 has an overall thickness ranging between 100 nm to 3 microns.

In some embodiments, dielectric film layer 108 comprises an electrically non-conductive high-permeability magnetic material such as, but not limited to, a ferrite. In some embodiments, alternating layers of a magnetic dielectric film layer 108 with an electrically conductive magnetic film 107 may comprise a high-permeability conductive material may suppress eddy current loss.

In the illustrated embodiment, inductor traces 104 extend lengthwise in the y-direction of the figure, (e.g., extending into, and out of, the plane of FIG. 1A). In some embodiments, dielectric 105 and magnetic core cladding 106 extend along the length of inductor traces 104 and substantially cover inductor traces 104. In some embodiments, inductor traces 104 extend along package substrate core 103, where a base portion of magnetic core cladding 106 intervenes between package substrate core 103 and inductor traces 104.

Figure 1B:
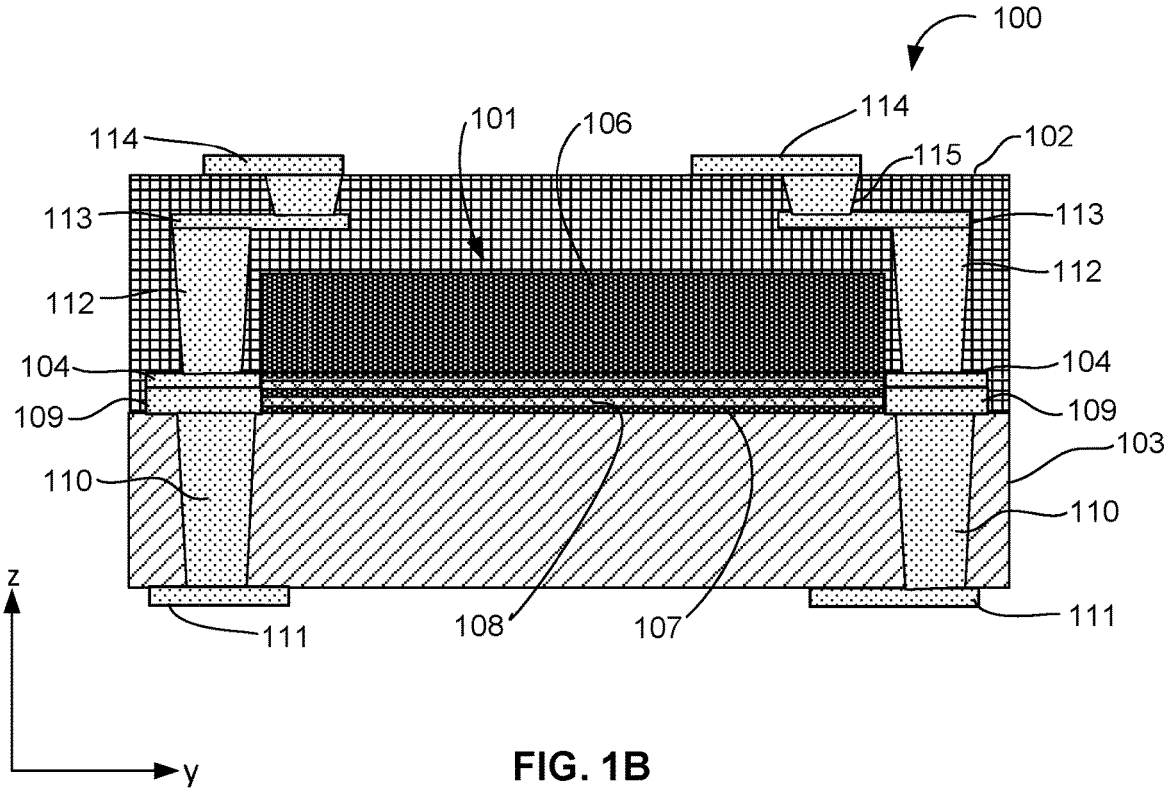
FIG. 1B illustrates a side view of an integrated inductor on a package substrate core, according to some embodiments of the disclosure.
Figure 1C:
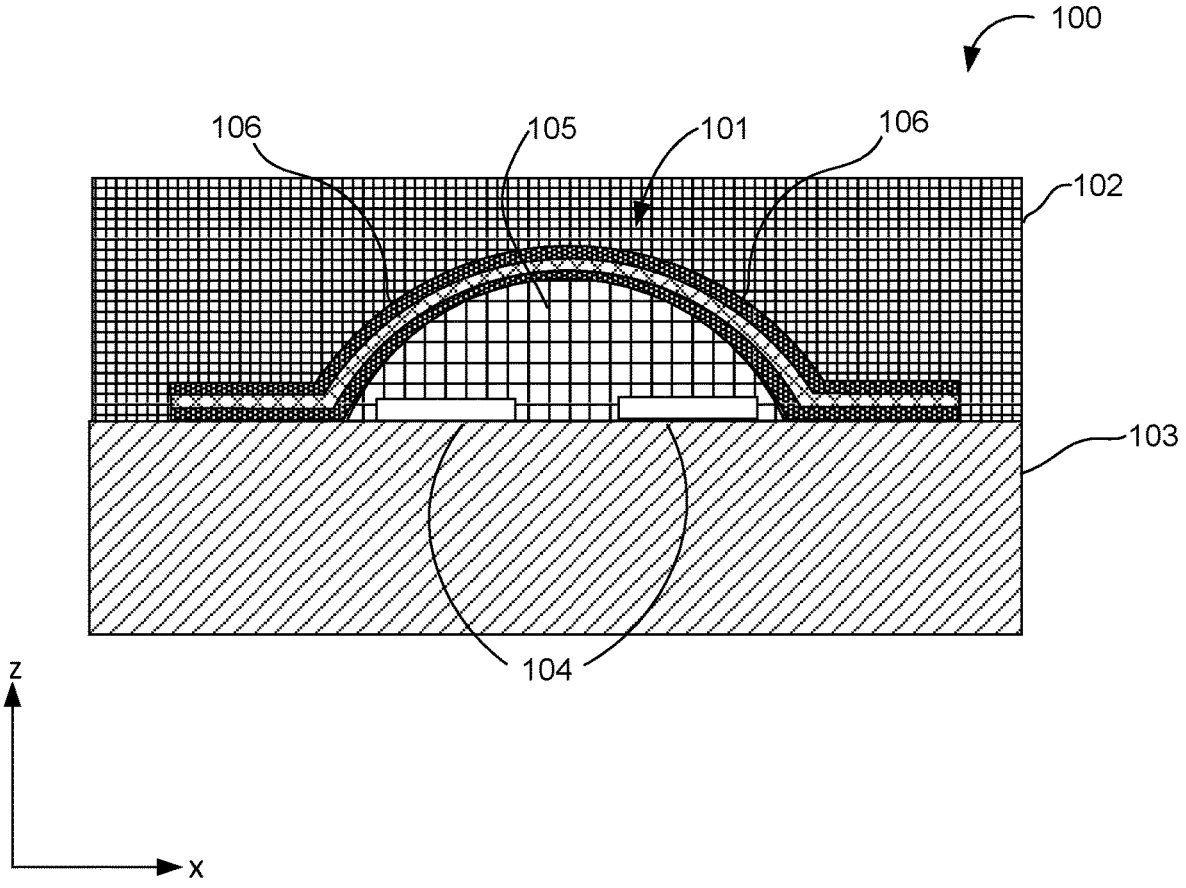
FIG. 1C illustrates a cross-sectional view of an alternative embodiment of an integrated inductor on a package substrate core, according to some embodiments of the disclosure.

In some embodiments, inductor traces 104 overlay package substrate core 103 directly (e.g., see FIG. 1C). In these embodiments, inductor traces 104 may be overlaid directly on dielectric film 108 of magnetic core cladding 106, and in intimate contact therewith. This architecture prevents short circuiting between two or more inductor traces 104, and prevents short circuiting to magnetic core cladding 106.

In some embodiments, cross-sectional and length dimensions of inductor traces 104 are in accord with current-carrying requirements and desired self-inductance. Cross-sectional dimensions (e.g., in the x-z plane) may range between 10 to 40 microns thick (e.g., the z-dimension), and between 100 microns to 2 mm in the width (e.g., the x-dimension). In some embodiments, inductor traces 104 comprise a single trace having a large width, resulting in a large cross-sectional aspect ratio. A single trace having a large cross-sectional aspect ratio may have a higher self-inductance than two adjacent traces that have smaller cross-sectional aspect ratios.

In some embodiments, inductor traces 104 comprise a conductive material, such as, but not limited to, copper, nickel, aluminum or polysilicon. Dielectric 105 separates and insulates inductor traces 104 from magnetic core cladding 106. In some embodiments, dielectric 105 is an insulating sheath around inductor traces 105. In some embodiments, dielectric 105 extends over package substrate core 103 as an island, and has a form factor comprising a lengthwise extent (e.g., the y-dimension) that is substantially greater than the width (e.g., x-dimension). In some embodiments, dielectric 105 has a substantially continuously curved upper surface, where the cross section is curved, as shown in FIG. 1A. The curvature of the cross-section may facilitate formation of a contiguous magnetic core cladding 106 during manufacture, for example as further described below. The curvature may be induced by surface tension, for example, and be a function of a contact angle have a mean curvature with minimal asperities (e.g., sharp edges) and small angles. Such may cause cracks and discontinuities in magnetic core cladding 106, particularly where cladding 106 comprises a multi-layered stack of films that are advantageously thin individually. The curvature of dielectric 105 may vary, and may be a function of the x-width and z-height of dielectric 105. In some embodiments, the curvature is achieved by process conditions (see below).

FIG. 1B illustrates a profile view of integrated inductor 101 on package substrate core 103, according to some embodiments of the disclosure.

In FIG. 1B, the lengthwise extension of integrated inductor 101 within package substrate 100 is illustrated. In the illustrated embodiment, magnetic core cladding 106 extends along package substrate core 103, underneath inductor traces 104. In the illustrated embodiment, alternating layers of magnetic film 107 and dielectric film 108 are exposed in an edge view of the portion of magnetic core cladding extending in the x-direction along package substrate core 103.

In some embodiments, inductor traces 104 extend beyond the limits of magnetic core cladding 106. Inductor traces 104 may be coupled to conductive layers within package substrate 100 and to conductive structures on package substrate core 103. This is shown in FIG. 1B, where inductor traces 104 are bonded to embedded conductive structures 109 on package substrate core 103. In some embodiments, conductive structures 109 are traces within a conductive level of package substrate 100. In some embodiments, conductive structures 109 are bond pads within a conductive level of package substrate 100. In some embodiments, inductor traces 104 are coupled to conductive level 111 by vias 110 that extend through package substrate core 103. In some embodiments, vias 110 are bonded to both ends of inductor traces 104. Vias 110 may couple inductor traces 104 to embedded traces 111 within package substrate 100 on the opposite side of package substrate core 103.

In some embodiments, inductor traces 104 are bonded to vias 112 that extend through package dielectric 102, coupling to conductive structures 113. In some embodiments, conductive structures 113 are embedded traces in an embedded conductive level above that of inductor traces 104. Conductive structures 113 may be coupled to conductive structures 114 on the surface of dielectric 102 through vias 115. In some embodiments, conductive structures 114 are bond pads for bonding a die, such as a microprocessor die, to package substrate 100. In some embodiments, conductive structures 114 are traces that lead between bond pads, or to other bond pads on the surface of dielectric 102.

According to some embodiments, the architecture of integrated inductor 101 provides for enhanced inductance, therefore higher Q, by confining magnetic core cladding 106 in a region that is in close proximity to inductor traces 104. This is in contrast to other embedded inductive structures having air or solid dielectric cores, or magnetic cores comprising thin magnetic films or thick magnetic plates within or on the top of the package substrate dielectric. In some embodiments, magnetic materials in magnetic core cladding 106 have a large relative magnetic permeability μ. The overall relative permeability μ of magnetic core cladding 106 ranges between 5 (nanocomposites) and 1000 (CZT), according to some embodiments.

The close proximity (0.1 to 10 microns) of relatively high-permeability of magnetic core cladding allows for a significant increase of inductance in comparison to embedded air core inductors. The increase in Q (ratio of energy stored in the magnetic field of the inductor to energy dissipated as resistive losses) increases the efficiency of the device to which integrated inductor 101 is coupled.

In some embodiments, device circuitry to which inductor traces 104 may be coupled are typically integrated voltage regulators (IVRs), such as fully integrated voltage regulators (FIVRs) on board a microprocessor die that may be attached to package substrate 100. Integrated inductors 101 may serve as off-die inductor components for an IVR or FIVR having a buck converter topology, a boost converter topology, or a buck/boost converter topology. In some embodiments, integrated inductors 101 are off-die inductive components in radio frequency (RF) circuits, such as, but not limited to, oscillator circuits, amplifier circuits, impedance matching circuits and filter circuits.

FIG. 1C illustrates a cross-sectional view of an alternative embodiment integrated inductor 101, according to some embodiments of the disclosure.

In the illustrated embodiment shown in FIG. 1C, magnetic core cladding 106 partially encloses dielectric 105, where magnetic core cladding 106 overlays the curved portion of dielectric 105, and does not extend below dielectric 105 and inductor traces 104. In some embodiments, inductor traces 104 overlay package substrate core 103 directly. According to some embodiments, the partial cladding architecture provides a processing advantage by eliminating the step of depositing magnetic core cladding 106 material over package substrate core 103 as a preliminary step to plating inductor traces 104.

Figure 2A:
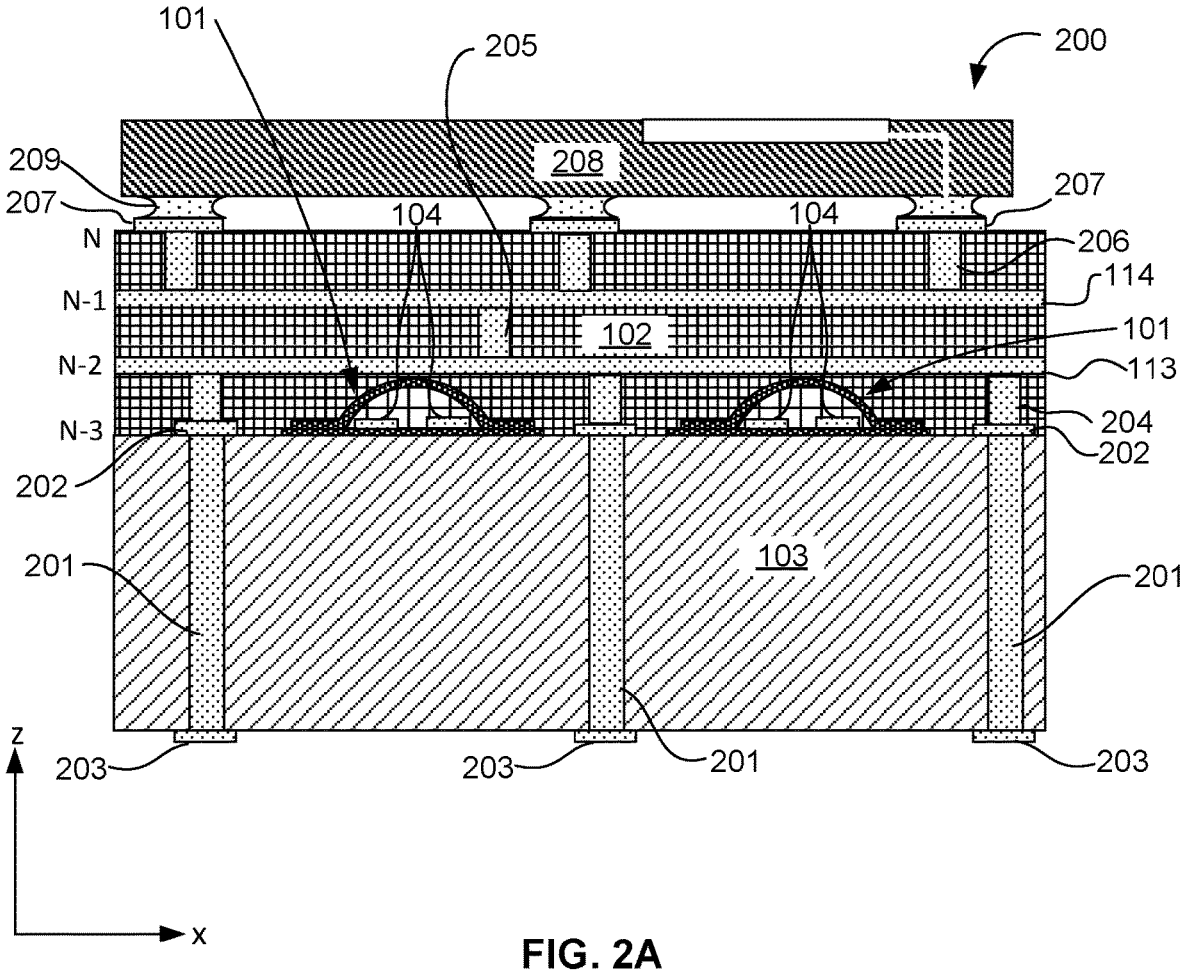
FIG. 2A illustrates a cross-sectional view of a package substrate, showing an array of integrated inductors over one side of package substrate core, according to some embodiments of the disclosure.

FIG. 2A illustrates a cross-sectional view of package substrate 200, showing an array of integrated inductors 101 over one side of package substrate core 103, according to some embodiments of the disclosure.

In FIG. 2A, a package architecture is shown where package substrate 200 comprises integrated inductors 101 arranged in an array. While two integrated inductors 101 are shown in the illustrated embodiment, it is understood that the array extends in the x-direction or y-direction along package substrate core 103, and may comprise multiple integrated inductors 101. In some embodiments, package substrate 100 is a build-up film substrate. Layers within package substrate 100 generally alternate between dielectric 102 and conductive layers labeled N, N−1, N−2, etc., starting with level N at the substrate surface. In the illustrated embodiment, four conductive levels, labeled N through N−3, are shown. Level N−3 is the deepest conductive level, and is immediately adjacent to package substrate core 103.

Integrated inductors 101 are embedded within package dielectric 102 at conductive level N−3, supported on package substrate core 103. Vias 201 are shown flanking integrated inductor 101 and extending through package substrate core 103 and interconnecting conductive structures 202 and 203 on opposing surfaces of package substrate core 103. In some embodiments, conductive structures 202 and 203 are bond pads. In some embodiments, conductive structures 202 and 203 are traces. In some embodiments, conductive structures 203 are land-side pads that may serve as bonding pads to solder-bond external dies or other flip-chip components. In some embodiments, conductive structures 203 are solder bumped for bonding a completed package comprising package substrate 100 to a printed circuit board, such as a computer motherboard.

Conductive structures 202 within conducive level N−3 may be laterally coupled to inductor traces 104. In some embodiments, vias 204 vertically interconnect conductive structures 202 to conductive structures 113 in conductive level N−2. Via 205 vertically routes conductive structures 202 to conductive structures 114 in level N−1, which is interconnected to top-level conductive structures 207 in surface conductive level N by vias 206. In this way, inductor traces 104 may be connected to top-level conductive structures 207.

In some embodiments, top-level conducive structures 207 are bond pads for flip-chip die bonding, where die 208 is a microprocessor die bonded to conductive structures 207 by solder joints 209. In some embodiments, microprocessor die 208 may comprise FIVR circuitry for managing power within the die, independent of voltage regulation circuits on the motherboard. In some embodiments, vertical routing mediated by interconnecting vias (e.g., vias 204-206) interconnect inductor traces 104 to top-level conductive structures 207. On board trace routing on microprocessor die 108 couple FIVR circuitry that is contained on-board microprocessor die 208 may be interconnected with inductor traces 104 through the vertical routing example shown in FIG. 2A.

As package footprint shrinks, placement of integrated inductors 101 at the deepest level within package substrate 200 over package substrate core 103 distances any attached integrated circuits carried on die 208 as far as possible from the magnetic fields generated by integrated inductors 101. Magnetic fields generated by current-carrying inductor traces 104 are mostly confined within magnetic core cladding 106 that surrounds inductor traces 104 in close proximity, however some of the magnetic field may leak from magnetic core cladding 106. Leakage magnetic fields are mitigated by the cladding architecture.

Figure 2B:
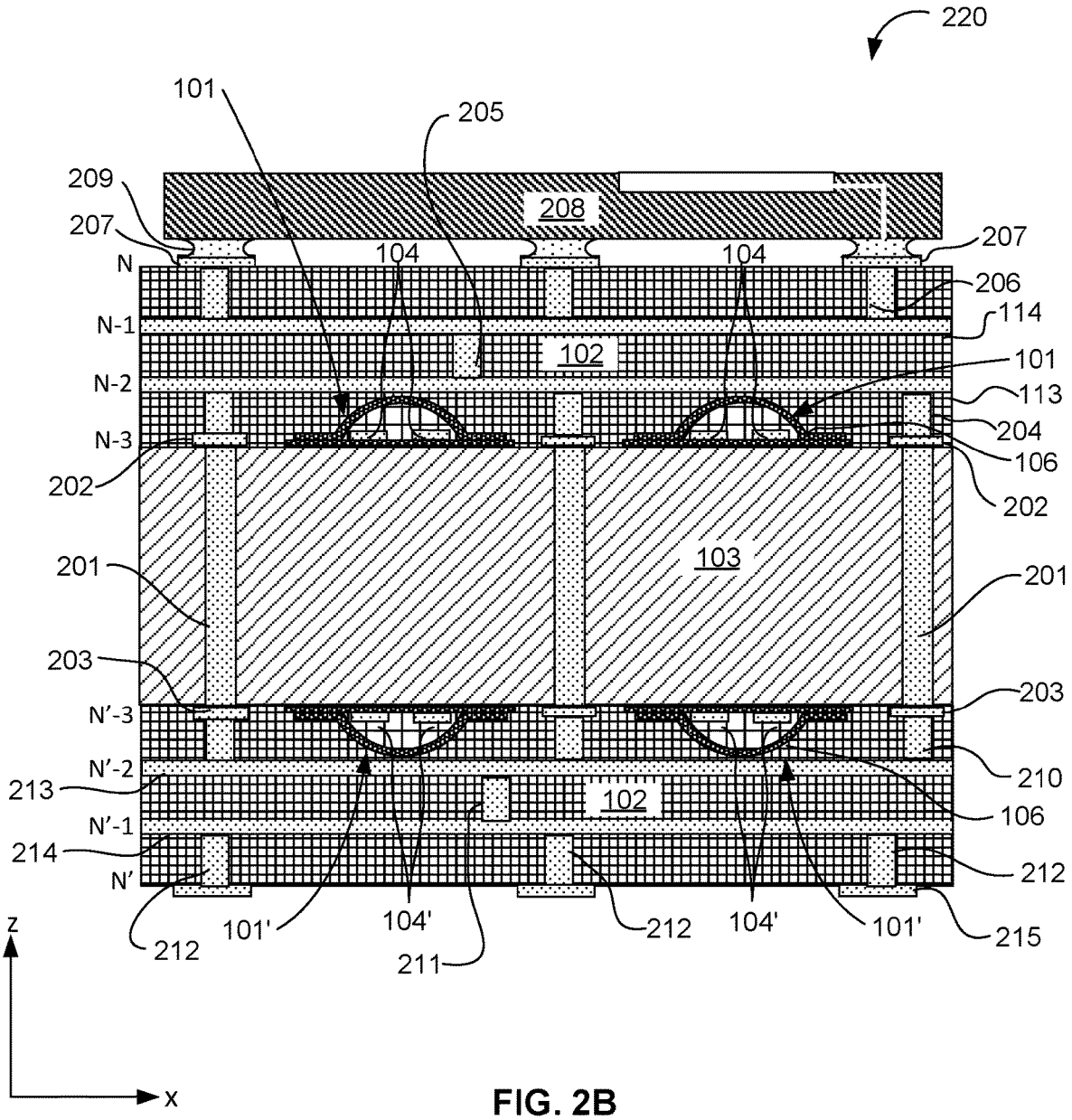
FIG. 2B illustrates a cross-sectional view of a package substrate, showing two arrays of integrated inductors on both sides of package substrate core, according to some embodiments of the disclosure.

FIG. 2B illustrates a cross-sectional view of package substrate 220, showing two arrays of integrated inductors 101 and 101' on both sides of package substrate core 103, according to some embodiments of the disclosure.

The symmetric package architecture shown in FIG. 2B comprises an array of integrated inductors 101' supported on the land (lower) surface of package substrate core 103, in opposition to the array of integrated inductors 101 supported on the die (upper) surface of package substrate core 103. In some embodiments, inductor traces 104' of integrated inductors 101' are coupled to through-hole vias 201, enabling coupling of traces 104' to attached ICs on the die side of package substrate core 103. In some embodiments, dies may be attached on the land side of package substrate 220, to which integrated inductors 104' are coupled.

In a similar manner, vertical routing on the land side of package substrate core 103 is mediated by vias 210, 211 and 212, interconnecting conductive structures 203, 213, 214 and 215 in conductive levels N', N'−1, N'−2, and N'−3, respectively. Level N'−3 is the deepest conductive level, adjacent to package substrate core 103 on the land side. Inductor traces 104' are located within conductive level N'−3, which is vertically interconnected to conductive structures (e.g., structures 207 and 215) in both conductive levels N and N'.

In some embodiments, land side integrated inductors 101' are larger inductors that handle larger currents than die side integrated inductors 101, for managing larger power requirements of certain ICs. Larger magnetic fields are generated by the larger currents running through inductor traces 104' and leakage fields may extend further from magnetic core cladding 106 than from integrated inductors 101. Increased isolation of integrated inductors 101' from die-side integrated circuit dies, such as die 208, may therefore be enabled by location of integrated inductors 101' on the land side of package substrate core 103.

In some embodiments, individual integrated inductors 101' are coupled to separate integrated circuits. In some embodiments, integrated inductors 101' are coupled in parallel to a common source, and distributed to separate buck or boost converter circuits in a IVR. In some embodiments, integrated inductors 101' are coupled in series to increase inductance. In some embodiments, integrated inductors 101' are inductive components of radio frequency (RF) ICs.

Figure 3I:
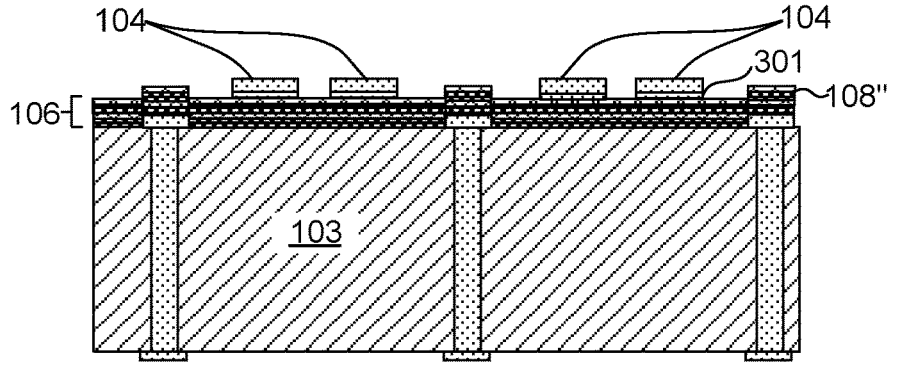
FIGS. 3A-3R illustrate a series of operations in an exemplary method for making integrated inductors within a package substrate having a package core.
Figure 3J:
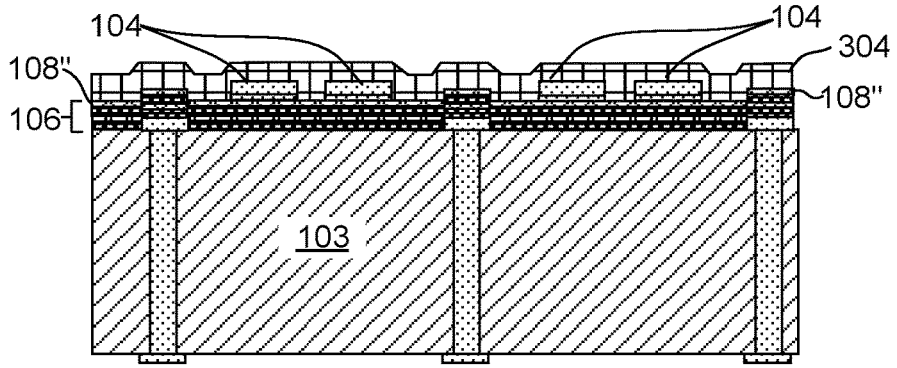
Figure 3K:
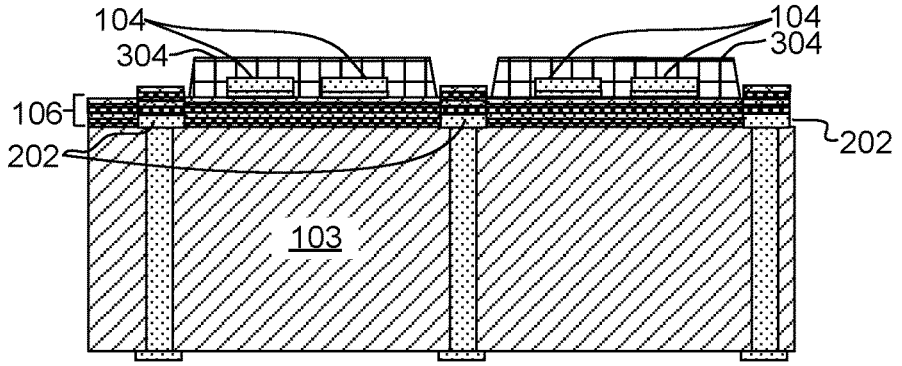
Figure 3L:
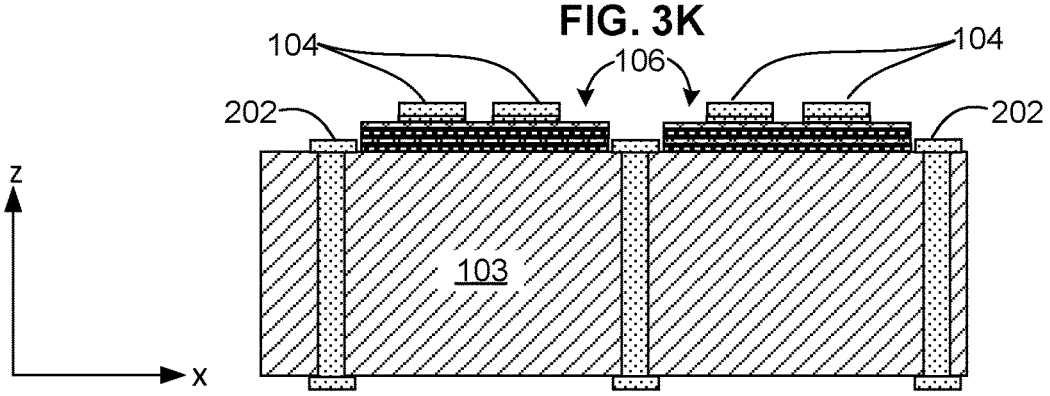
Figure 3P:
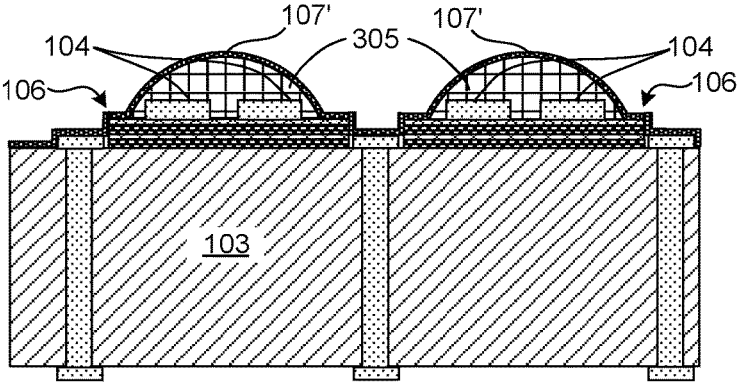
Figure 3Q:
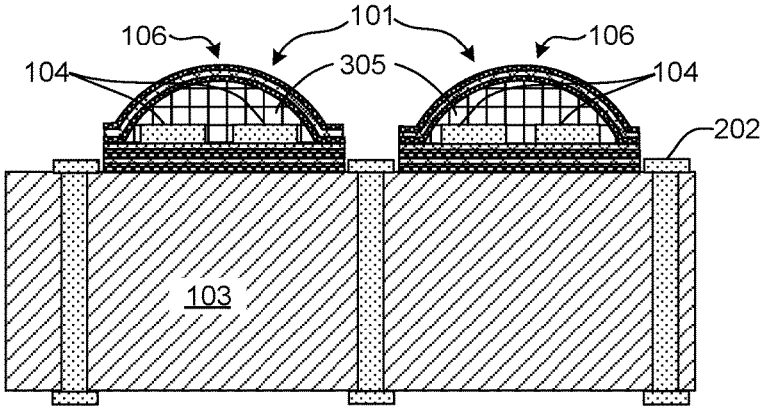
Figure 3R:
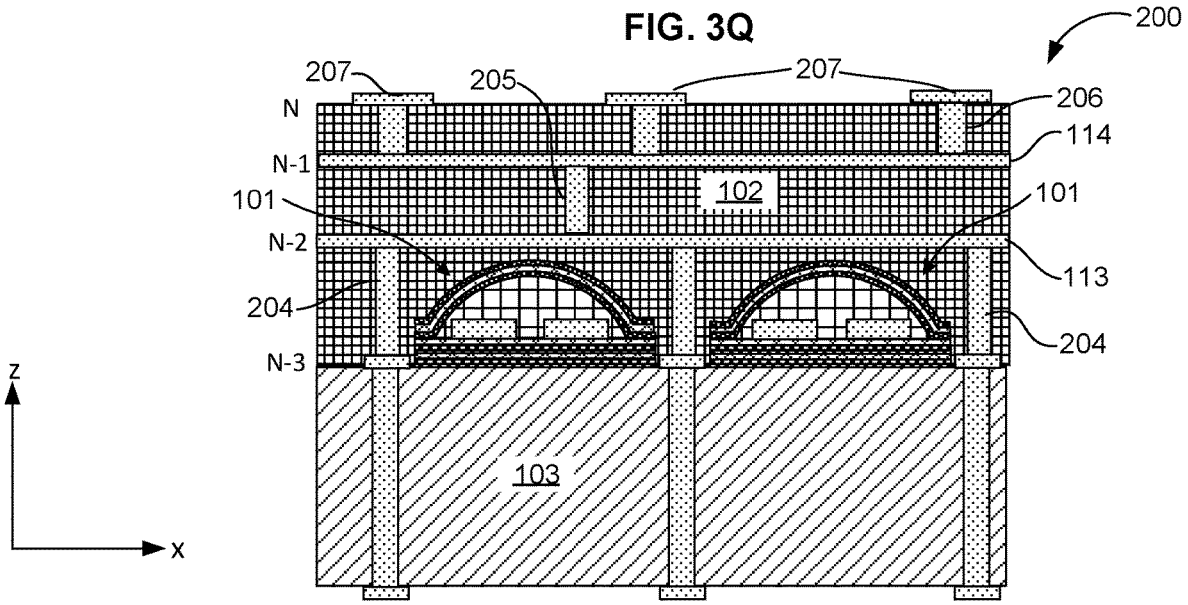

FIGS. 3A-3R illustrate a series of operations in an exemplary method for making integrated inductors 101 within package substrate 200 having a glass or monocrystalline package core 103.

In the operation illustrated in FIG. 3A, package substrate core 103 is received in a prepared state. In some embodiments, package substrate core 103 comprises a glassy material, having an average surface roughness of 100 nm or less. Examples of glassy materials, such as soda-lime glass and borosilicate glass, have been listed above (e.g., see description relating to FIGS. 1A-1C). In some embodiments, package substrate core 103 is a glass sheet. In some embodiments, package substrate core 103 comprises a crystalline material, such as a monocrystalline silicon wafer having one or two surface polished to an average surface roughness of 100 nm or less. In the illustrated embodiment, through-holes have been made in the body of package substrate core 103, and copper has been deposited within the through-holes to create through-hole vias 201 that extend between opposing surfaces. In some embodiments, package substrate core 103 has a thickness that ranges between 100 microns to 500 microns. In some embodiments, package substrate core 103 has lateral dimensions that range between 2 millimeters to 10 millimeters. In some embodiments, through-holes are drilled through package substrate core 103 by a mechanical drilling process. In some embodiments, through-holes are drilled through package substrate core 103 by a laser drilling process. In some embodiments, through-holes are etched by a dry etch process (e.g., deep reactive ion etching) or by a wet chemical etch process.

In some embodiments, a metal, such as, but not limited to, copper or nickel, is electroplated into the through-holes. The electrodeposition process may be preceded by deposition of a conductive seed layer on at least one surface of package substrate core 103. The seed layer may comprise any suitable metal film. In some embodiments, the seed layer is deposited by vacuum deposition techniques, such as evaporation or DC sputtering. In some embodiments, a thin metal foil, such as copper foil, has been laminated on the surface of package substrate core 103.

In some embodiments, conductive structures 202 and 203 are formed at the terminations of through-hole vias 201 by electroplating, where vias 201 exceed the through-holes and extend laterally over the seed layer on package substrate core 103 as a raised pad. In some embodiments, conductive structures 202 and 203 are formed by patterning a thin metal foil laminate.

In the operation illustrated in FIG. 3B, formation of the magnetic core cladding (e.g., magnetic core cladding 106 in FIG. 1A) begins with deposition of first magnetic film 107' over package substrate core 103. First magnetic film 107' may comprise a conductive magnetic material or a non-conductive magnetic material. Examples of suitable magnetic materials are given above (e.g., see the discussion relating to FIG. 1A). First magnetic film 107' may be deposited by any suitable method, such as, but not limited to, direct current (DC) sputtering, radio frequency (RF) sputtering, evaporation, chemical vapor deposition, liquid phase deposition, electrodeposition or electroless deposition. First magnetic film 107' has a thickness that ranges between 50 to 200 nm.

In the operation illustrated in FIG. 3C, first dielectric film 108' is deposited over the first magnetic film 107' as part of the deposition of magnetic core cladding 106. First dielectric film 108' comprises a suitable dielectric material that may be deposited as a thin film and is compatible with the underlying layer, in terms of thermal expansion (e.g., coefficient of thermal expansion, CTE), and chemical compatibility, including that of any film precursors. Examples of suitable materials are given above. In some embodiments, first dielectric film 108' may comprise a non-conducting magnetic material, such as, but not limited to, a ferrite ceramic. In some embodiments, first dielectric film 108' has a CTE that is compatible with first magnetic film 107' to mitigate stress in the magnetic core cladding.

First dielectric film 108' may be deposited by any suitable method that promotes formation of thin films, and is compatible with both first magnetic film 107' and package substrate core 103. In general, the deposition process conditions should not disturb the integrity of first magnetic film 107' or package substrate core 103. Deposition temperatures below the glass transition temperature of package substrate core 103 and the melting point or solidus temperatures of first magnetic film 107' are considered suitable conditions. Deposition techniques and atmospheres that do not damage, oxidize or otherwise chemically react with first magnetic film 107' are also considered suitable conditions. Suitable methods may include RF sputtering, chemical vapor deposition, and liquid phase deposition. In some embodiments, the thickness of first dielectric film 108' ranges between 50 and 200 nm.

In the operation illustrated in FIG. 3D, formation of magnetic core cladding 106 continues with the deposition of second magnetic film 107" over first dielectric film 108'. In some embodiments, second magnetic 107" film comprises substantially the same composition as comprised by first magnetic film 107'. In some embodiments, second magnetic film 107" has a substantially different composition than that of first magnetic film 107'. Second magnetic film 107" may be deposited by the same method as used for first magnetic film 107'. Suitable deposition conditions do not perturb the underlying layers either physically or chemically. Examples of materials comprised by second (and first) magnetic film 107" are generally the same as those given for first magnetic film 107'.

Second magnetic film 107" may be deposited by any suitable method that is compatible with the underlying films deposited in previous operations (e.g., FIGS. 3A-3C), and with package substrate core 103. Suitable conditions are those described above for FIGS. 3B and 3C. Deposition processes include, but are not limited to, direct current (DC) sputtering, radio frequency (RF) sputtering, evaporation, chemical vapor deposition, liquid phase deposition, electrodeposition or electroless deposition. In some embodiments, second magnetic film 107" has a thickness that ranges between 50 to 200 nm.

In the operation illustrated in FIG. 3E, formation of magnetic core cladding 106 continues with the deposition of second dielectric film 108" over second magnetic film 107". In some embodiments, magnetic core cladding 106 comprises the stack comprising first magnetic film 107', first dielectric film 108', second magnetic film 107", second dielectric film 108" In some embodiments, second dielectric film 108" comprises substantially the same composition as that comprised by first dielectric film 108'. In some embodiments, second dielectric film 108" has a substantially different composition than that of first dielectric layer 108'. Examples of materials comprised by second dielectric film 108" may be generally the same as those given for first dielectric film 108'. Suitable deposition conditions are generally physically and chemically compatible with underlying layers (e.g., first and second magnetic films 107' and 107", respectively, and first dielectric film 108'), and package substrate core 103. Second dielectric film 108" has a CTE that is substantially the same as second magnetic film 107".

In some embodiments, the operation illustrated in FIG. 3E further comprises deposition of electrodeposition seed layer 301 over magnetic core cladding 106. In some embodiments, seed layer 301 comprises a conductive metal, such as, but not limited to, copper, nickel, or aluminum. Seed layer 301 may be deposited by thin film techniques such as, but not limited to, DC sputtering, RF sputtering and evaporation. In some embodiments, seed layer 301 has a thickness ranging between 50 and 200 nm.

Successful formation of even and contiguous thin-film layers (e.g., first magnetic film 107', first dielectric film 108', second magnetic film 107", second dielectric film 108") depends on low average surface roughness (e.g., less than 100 nm) provided by the surfaces of package substrate core 103. In some embodiments, package substrate core 103 comprises a glassy material, as described earlier. In some embodiments, package substrate core 103 is in the form of a glass sheet having an average surface roughness of 100 nm or less. In some embodiments, package substrate core 103 comprises a single crystalline material, such as a monocrystalline silicon wafer. The monocrystalline surface may be polished to a surface roughness of less than 100 nm. Larger surface roughnesses may lead to creation of lower quality films due to discontinuities and asperities, resulting in an inferior performance of magnetic core cladding 106.

In the operation illustrated in FIG. 3F, electrodeposition mask 302 is deposited over seed layer 301 (over magnetic core cladding 106). In some embodiments, electrodeposition mask 302 is a photoresist layer. In some embodiments, electrodeposition mask 302 is deposited by spin coating methods. In some embodiments, electrodeposition mask 302 is deposited by spray coating methods. In some embodiments, electrodeposition mask 302 is a dry film resist, and is laminated over seed layer 301. In some embodiments, electrodeposition mask is a patternable non-photosenstive dielectric layer.

In the operation illustrated in FIG. 3G, electrodeposition mask 302 is patterned to create openings 303 in which metal is to be electroplated in a subsequent operation. Openings 303 expose seed layer 301 over magnetic core cladding 106. In some embodiments, electrodeposition mask 302 comprises a photoinitiator, and may be patterned by photolithographic methods suitable to pattern a positive or negative tone photoresist. In some embodiments, electrodeposition mask 302 is patterned by a dry etch process, such as plasma or reactive ion etching, with seed layer 301 serving as an etch stop. In some embodiments, electrodeposition mask 302 is deposited as an inorganic dielectric film over seed layer 301. In some embodiments, electrodeposition mask 302 comprises an inorganic dielectric material, such as, but not limited to, silicon oxide, silicon nitride or silicon carbide. A wet etch, such as an alkaline potassium hydroxide (KOH) etch, may be employed for patterning electrodeposition mask 302. In some embodiments, a dry method, such as argon ion bombardment, may be employed to pattern an electrodeposition mask 302 comprising an inorganic or organic dielectric material.

In the operation illustrated in FIG. 3H, a metal is electroplated into openings 303 in electrodeposition mask 302, forming inductor traces 104. In some embodiments, the metal is any of copper, nickel, silver or gold. In the electroplating process, package substrate core 103 is immersed into a plating bath. In some embodiments, seed layer 301 is a plating cathode (negative electrode) and is coupled to a two-terminal plating power supply or a three-terminal potentiostat. The electroplating process parameters of plating current and time are adjustable to control the thickness of inductor traces 104.

In the operation illustrated in FIG. 3I, the electrodeposition mask (e.g., electrodeposition mask 302 in FIGS. 3F-3H) is removed, exposing inductor traces 104 and seed layer 301. Removal of the electrodeposition mask may be performed by suitable photoresist wet stripping methods. In some embodiments, a wet etch such as a KOH etch is employed for electrodeposition masks comprising some inorganic materials, such as silicon oxides. In some embodiments, a dry etch removal process is employed, such as argon ion bombardment.

In some embodiments, seed layer 301 is etched to remove portions that are not covered by electroplated structures, such as inductor traces 104. Seed layer 301 may be etched by any of a number of suitable etching methods known in the art, depending on the composition of seed layer 301. Portions of seed layer 301 that extending over second dielectric film 108" are removed to electrically isolate two or more inductor traces 104 from each other, as seed layer 301 is generally conductive. Seed layer 301 may remain under inductor traces 104.

In the operation illustrated in FIG. 3J, etch mask 304 is deposited over second dielectric film 108" and inductor traces 104. In some embodiments, etch mask 304 comprises a hard photoresist material, such as, but not limited to, epoxy resin-based photoresists. Other suitable photoresist materials known in the art may also be employed. When patterned in subsequent operations, portions of magnetic core layer 106 (comprising first and second magnetic films 107' and 107", interleaved with first and second dielectric films 108' and 108") are exposed to be etched away.

In a manner similar to electroplating mask 302, etch mask 304 is deposited by any of spin coating, spray coating (for liquid photoresists), or dry film resist lamination. The thickness of etch mask 304 may be adjusted by coating conditions and choice of the viscosity of the liquid photoresist. Thickness and hardness of etch mask 304 may be adjusted to accommodate etch conditions.

In the operation illustrated in FIG. 3K, etch mask 304 is patterned to expose areas of magnetic core layer 106 that are to be removed in a subsequent operation. In some embodiments, etch mask 304 is patterned by photolithographic techniques. In some embodiments, etch mask 304 is etched by photoresist wet stripping methods known in the art. In some embodiments, etch mask 304 is etched by dry methods such as by an oxygen plasma or by a reactive ion etch.

In some embodiments, etch mask 304 is patterned to protect portions of magnetic core layer 106 adjacent to inductor traces 104, and remove portions of magnetic core layer 106 over conductive structures 202.

In the operation illustrated in FIG. 3L, exposed portions of magnetic core layer 106 are removed, exposing underlying package substrate core 103 and conductive structures 202. In some embodiments, magnetic core layer 106 is removed by metal etch solutions, attacking metallic magnetic layers (e.g., first and second magnetic films 107' and 107") between first and second dielectric films 108' and 108". In some embodiments, magnetic core layer 106 is etched by reactive ion etching processes. Conductive structures 202 are not affected by etchants used to attack magnetic core layer 106, according to some embodiments.

After etching of magnetic core layer 106, the etch mask (e.g., etch mask 304) is removed by photoresist stripping processes, according to some embodiments. Photoresist stripping processes include wet chemical stripping, dry stripping techniques such as argon ion bombardment (sputtering) and reactive ion etching processes. In some embodiments, magnetic core layer 106 is patterned into strips extending lengthwise in the y-direction (into an out of the plane of the figure) or into islands having a small aspect ratio in the x-y plane.

In the operation illustrated in FIG. 3M, photoresist 305 is deposited over package substrate core 103. In some embodiments, photoresist 305 is a resin-based material. In some embodiments, photoresist 305 is deposited by spin coating, spray coating, or as a dry film resist. Photoresist 305 covers all structures on package substrate core 103, including inductor traces 104, magnetic core layer 106, conductive structures 202 and package substrate core 103.

In the operation illustrated in FIG. 3N, photoresist 305 is patterned into islands substantially embedding inductor traces 104 but exposing adjacent regions of magnetic core layer 106. In some embodiments, islands of photoresist 305 extend in the y-direction. In some embodiments, islands of photoresist have a small aspect ratio in the x-y plane.

In the operation illustrated in FIG. 3O, photoresist 305 is heated beyond its melting point to create curved upper surfaces. In some embodiments, the upper surface is convex. In some embodiments, photoresist 305 is heated to temperatures ranging between 150° C. and 220° C., for times ranging between 1 and 10 minutes. A curved profile may mitigate asperities and sharp angles, which may cause cracks and discontinuities in the magnetic core cladding. The curvature of dielectric is arbitrary, and may be a function of the x-width and z-height of the patterned dielectric island. In some embodiments, the upper surface of the dielectric is convex, having a semicircular or lens-shaped cross-section.

In the operation illustrated in FIG. 3P, formation of a second portion of magnetic core cladding 106 begins with the deposition of first magnetic film 107' over package substrate core 103, covering photoresist 305. The second portion of magnetic core cladding is formed over patterned photoresist 305 to enclose inductor traces 104 within a magnetic core. In some embodiments, first magnetic film 107' is deposited to a thickness ranging between 50 and 200 nm. In some embodiments, photoresist 305 has a curved upper surface, resulting from the thermal treatment of the previous operation (e.g., FIG. 3O). In some embodiments, the deposition of first magnetic film 107' covers the entire surface of package substrate core 103. Suitable deposition methods have been described above (e.g., see the description relating to FIGS. 3B-3E).

Subsequent layers of magnetic film and dielectric film (e.g., first dielectric film 108', followed by second magnetic film 107", followed by second dielectric film 108") are deposited to construct magnetic core layer 106 over the curved top surfaces of islands of photoresist 305.

In the operation illustrated in FIG. 3Q, magnetic core layer 106 is completed and patterned to isolate separate the individual integrated inductors 101. In some embodiments, magnetic core layer 106 is terminated with second dielectric film 108". In some embodiments, deposition of additional alternating layers of magnetic film interleaved with dielectric film is carried out to form a higher permeance magnetic core cladding, capable of concentrating more magnetic flux within the cladding. In some embodiments, magnetic core cladding 106 comprises a stack of up to 10 layers of magnetic film layers 107'. In some embodiments, portions of newly deposited magnetic core layer 106 laterally extend from the islands of photoresist 305 over the flat portions of magnetic core layer 106 underlying inductor traces 104. In some embodiments, magnetic core layer 106 fully surrounds inductor traces 104, which are embedded in the islands of photoresist 305.

In the operation illustrated in FIG. 3R, fabrication of package substrate 200 is completed, according to some embodiments. Package substrate 200 comprises integrated inductors 101 on package substrate core 103, embedded within package dielectric 102. In some embodiments, package substrate 200 is fabricated by lamination of build-up film comprising package dielectric 102. Conductor levels N−2, N−1 and N, comprising conductive structures 113 and 114, and top-level conductive structures 207, respectively, are deposited over layers of package dielectric 102 and patterned. In some embodiments, conductive structures 113, 114 and 207 are interconnected by vias 204, 205 and 206.

Figure 4:
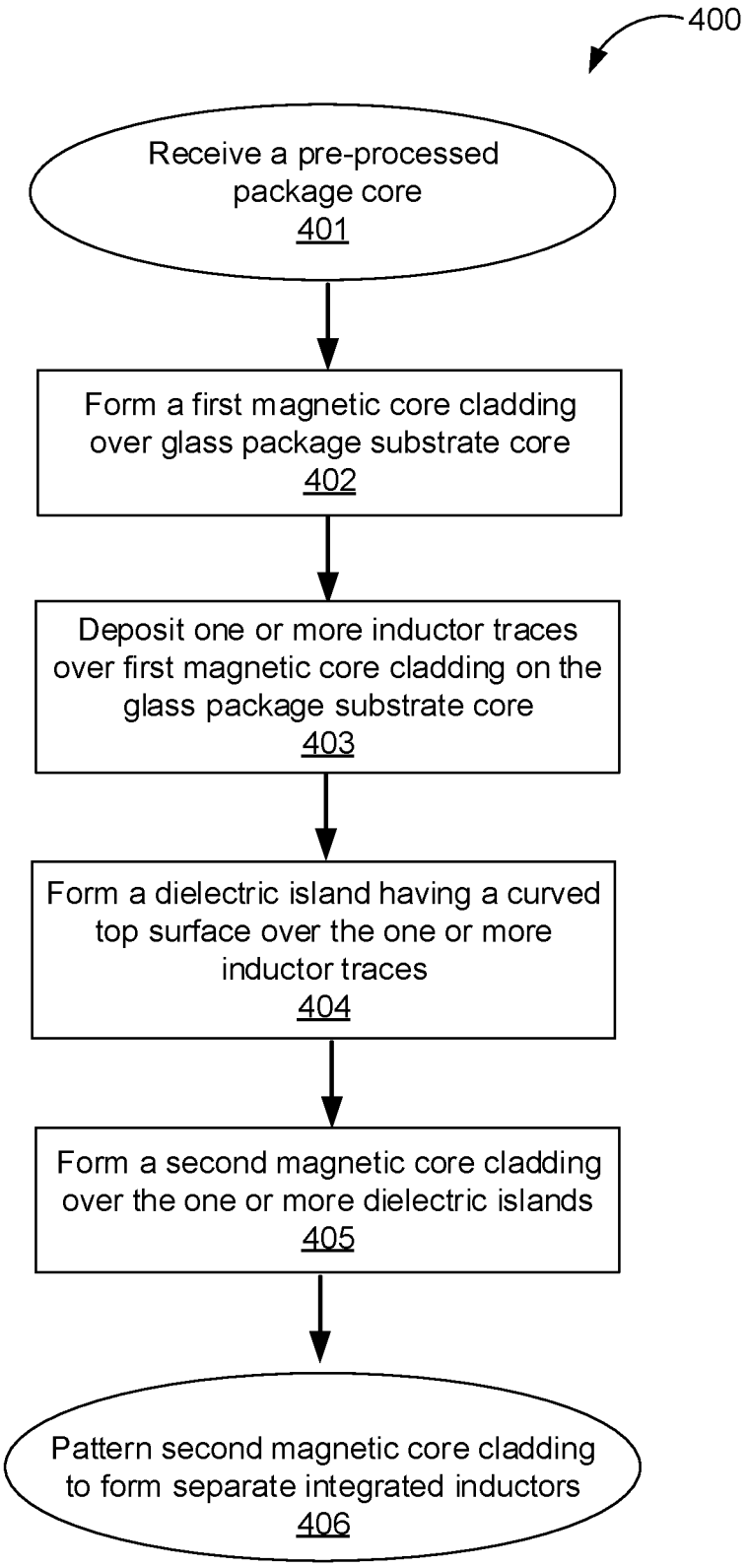
FIG. 4 illustrates a block diagram summarizing the method illustrated in FIGS. 3A-3R, according to some embodiments of the disclosure.

FIG. 4 illustrates a block diagram 400 summarizing the method illustrated in FIGS. 3A-3R, according to some embodiments of the disclosure.

At operation 401, a package substrate core (e.g., package substrate core 103 in FIG. 1A) is received in a pre-processed state. In some embodiments, the package substrate core is received having through-vias (e.g., through-vias 201 in FIG. 2A). In some embodiments, through-vias are made by drilling through-holes in package substrate core 103 by mechanical drilling or laser drilling in a previous operation. In some embodiments, the package substrate core is a glass sheet that is 100 microns to 500 microns thick (a list of suitable glass materials is given above). In some embodiments, the package substrate core is a monocrystalline wafer, such as a monocrystalline silicon wafer (a list of monocrystalline materials is given above). In some embodiments, through-holes are made by deep reactive ion etching.

A suitable metal is electroplated into the through-holes made in the package core in a previous operation. In some embodiments, copper is electroplated into the through-holes. In some embodiments, a seed layer for electroplating is formed over one or both surfaces of the package core, where the seed layer may serve as a cathode for electroplating. The seed layer may be any suitable metal film. In some embodiments, the seed layer is deposited by vacuum deposition techniques, such as evaporation or DC sputtering.

Conductive structures (e.g., conductive structures 202 and 203 in FIG. 2A) may be formed at the openings of through-holes may result from lateral overgrowth of electroplated metal from plated metal within the through-holes. Other methods may include patterning the seed layer to produce structures such as bonding pads and traces (conductive structures 202 and 203 in FIG. 2A) on the surface of the package core.

At operation 402, a first magnetic core cladding layer is formed on the package substrate core. In some embodiment the first magnetic core cladding layer is a base for the integrated inductors. In some embodiments, this operation is omitted. As described above, magnetic core cladding comprises a stack of magnetic film layers (e.g., first and second magnetic films 107' and 107") interleaved with dielectric layers (e.g., first and second dielectric films 108' and 108"). A first magnetic film layer is deposited over the package core, covering the surface and any conductive structures, such as bond pads and traces. The first magnetic film may be deposited by any suitable thin-film method as described above, and have a thickness ranging for 50 nm to 200 nm. In some embodiments, the first magnetic film comprises a conductive magnetic material. In some embodiments, first magnetic film comprises a non-conductive magnetic material (e.g., a ferrite). A detailed list of suitable magnetic materials is given above).

In some embodiments, the magnetic film layer is non-conductive, comprising a material such as a ferrite. Interleaving non-conductive magnetic film layers with dielectric film layers is optional. In some embodiments, the magnetic core cladding comprises only layers of non-conductive magnetic materials. For conductive magnetic materials, magnetic film layers are interleaved with dielectric film layers to suppress eddy current losses caused by magnetic flux lines penetrating the magnetic core during operation of the device incorporating the integrated inductor(s).

Deposition of a first dielectric film (e.g., first dielectric film 108') follows deposition of a first magnetic film. The first dielectric film may comprise a silicon oxide, tantalum oxide, silicon nitride or silicon oxynitride. A list of suitable materials for first dielectric film is given above. The first dielectric film may have a thickness ranging between 50 and 200 nm.

Following deposition of the first dielectric film, a second magnetic film (e.g. second magnetic film 107") may be deposited over the first dielectric film. In some embodiments, the second magnetic film may have a substantially identical composition and thickness as the first magnetic film. In some embodiments, the second magnetic film may have a different composition and thickness than the first magnetic film. In some embodiments, the magnetic core cladding comprises a single dielectric film layer (e.g., first dielectric film 108') over a single magnetic film layer (e.g., first magnetic film 107'). In some embodiments, deposition of the first dielectric film is followed by deposition of a second magnetic film (e.g., second magnetic film 107"). In some embodiments, deposition of the second magnetic film is followed by deposition of a second dielectric layer (e.g., second dielectric film 108").

In some embodiments, termination of magnetic core cladding with a dielectric precedes deposition of inductor traces (e.g., inductor traces 104 in FIGS. 1A-1C, and FIG. 2A) over the magnetic core cladding that overlays the package substrate core (e.g., package substrate core 103 in FIGS. 2A and 2B). Deposition of two or more inductor traces over a dielectric surface of the magnetic core cladding may be necessary to prevent short-circuiting of the two or more inductor traces. In some embodiments, a single inductor trace is deposited for each integrated inductor (e.g., integrated inductor 101). In some embodiments, the magnetic film layers within the magnetic core cladding comprise an insulating magnetic materials, such as a ferrite. In this case, two or more inductor traces may be directly deposited over a terminal magnetic film layer without a terminal dielectric film layer of the magnetic core cladding. In some embodiments, magnetic core cladding comprises additional layers of magnetic film interleaved with dielectric film, forming a layer stack comprising more than four film layers.

At operation 403, one or more inductor traces (e.g., inductor traces 104 in FIGS. 1A-1C, and FIG. 2A) are deposited over the magnetic core cladding deposited over the package core. In some embodiments, a single inductor trace is deposited for each integrated inductor. In some embodiments two or more inductor traces are deposited for each integrated inductor. In some embodiments, the inductor traces have substantially rectangular cross sections. The cross-sectional dimensions may be adjusted to accommodate the intended current rating of the integrated inductor. Inductor traces may be patterned to form interconnections with the conductive structures on the package core.

As an example, an inductor trace having cross-sectional dimensions of 35 microns high in the z-direction by 200 microns wide in the x-direction (cross-sectional area of 0.007 $mm^2$ approximately equivalent to a 39 AWG copper wire, where AWG is American Wire Gauge) may carry a maximum current of approximately 100 milliamperes (mA). In some implementations, inductor traces may carry one ampere (amp) or greater. A cross sectional area of 0.065 $mm^2$ (equivalent to a 29 AWG copper wire) is rated for a maximum current of 1.2 amps. A rectangular cross section having dimensions of 35 microns×1860 microns (1.86 mm) is one example of cross-sectional dimensions of the inductor trace having a minimum cross-sectional area equivalent to a 29 AWG wire. Other cross-sectional dimensions that yield an adequate cross-sectional area may be chosen.

Multiple inductor traces may be ganged in parallel to distribute the currant along each inductor trace in order to maintain small inductor dimensions. A small z-height for the inductor may be desired to reduce overall z-height of the package. In some embodiments, the one or more integrated inductors comprise a single inductor trace having a large aspect ratio (in cross-section) to accommodate a large current of 1 amp or greater (e.g., an aspect ratio of approximately 50 for an inductor trace having the dimensions of 35 microns in the z-direction and 1860 microns on the x-direction).

At operation 404, inductor traces are covered by a patternable dielectric film that is deposited over the inductor traces and magnetic core cladding. In some embodiments, the patternable dielectric film comprises a polymer resin, which when heated, expands and forms a convex surface. In some embodiments, the patternable dielectric film is deposited over the package substrate core as a liquid photoresist. In some embodiments, a dry film photoresist is laminated over the package core. The patternable dielectric film covers may be deposited by spin coating or spray coating, the magnetic core cladding and inductor traces. The coated resin may be pre-baked and patterned to form dielectric islands over the inductor traces. In some embodiments, the patterned dielectric islands have a lateral extent (e.g., in the x-direction in FIGS. 1A-1C, 2A-2B) that overhang the one or more inductor traces, leaving a space between adjacent islands.

In some embodiments, the patterned dielectric islands are heated to expand the resin, where the resin transforms from a substantially rectangular or trapezoidal cross-sectional shape to an expanded curved or convex shape (e.g., see FIGS. 1A-1C). In some embodiments, the cross-sectional profile (e.g., in the x-z plane in FIGS. 1A-3R) of the patterned dielectric islands has a semicircular or (convex) lens shape. In some embodiments, the patterned dielectric islands extend lengthwise over package substrate core (e.g., in the z-direction in FIGS. 1A-3R), where the width (e.g., the x-dimension) of the patterned dielectric islands is substantially less than the length (z-dimension).

At operation 405, a second portion of the magnetic core cladding covering the patterned dielectric islands is deposited. The patterned dielectric islands embed the inductor traces and serve as a form for the second portion of the magnetic core cladding. In some embodiments, the deposition process to form the second portion of the magnetic core cladding is substantially the same as the process described for operation 402 above. In some embodiments, the composition of the second portion of the magnetic core cladding is substantially the same as the composition of the first portion of the magnetic core cladding. The second portion of the magnetic core cladding may comprise a single magnetic film layer or a stack of interleaved magnetic film layers and dielectric film layers. In some embodiments, the second or upper portion of the magnetic core cladding encloses the inductive traces with a magnetic core.

In some embodiments, the second portion of the magnetic core cladding joins the first portion of the magnetic core cladding in the spaces between the dielectric islands, where the first portion of the magnetic core cladding is exposed. The joining of first and second portions of the magnetic core cladding forms a closed magnetic core cladding surrounding the one or more inductor traces. The patterned dielectric islands serve to isolate the one or more inductor traces from the upper (second) portion of the magnetic core cladding. In some embodiments, the second portion of the magnetic core cladding is formed as a contiguous layer over the package substrate core.

At operation 406, the method terminates by patterning the second portion of the magnetic core cladding is patterned to form separate integrated inductors over the package substrate core (e.g., see FIG. 3Q).

Figure 5:
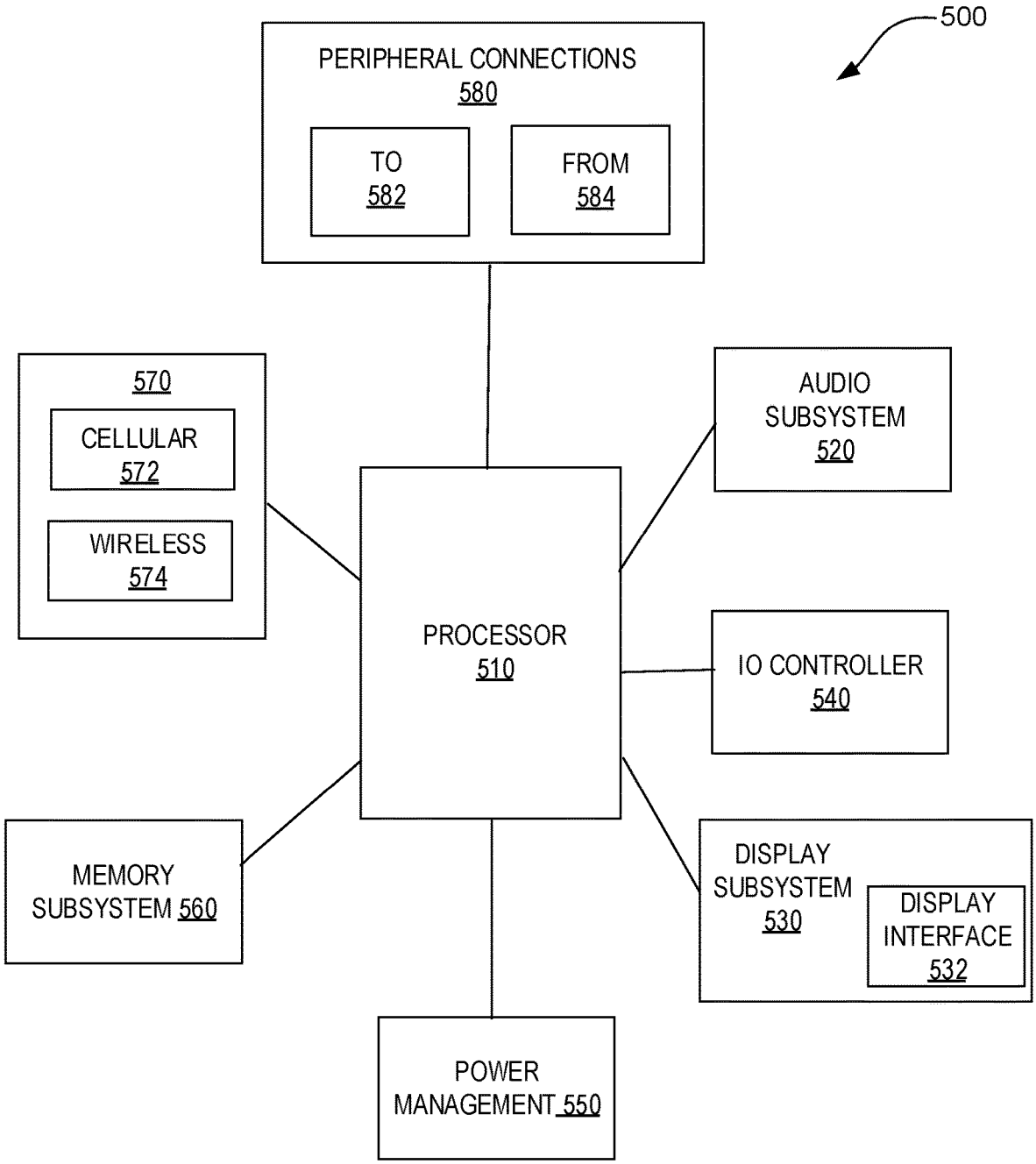
FIG. 5 illustrates a package having integrated inductors, fabricated according to the disclosed method, as part of a system-on-chip (SoC) package in an implementation of computing device, according to some embodiments of the disclosure.

FIG. 5 illustrates a package having integrated inductors, fabricated according to the disclosed method, as part of a system-on-chip (SoC) package in an implementation of computing device, according to some embodiments of the disclosure.

FIG. 5 illustrates a block diagram of an embodiment of a mobile device in which integrated inductors could be used. In some embodiments, computing device 500 represents a mobile computing device, such as a computing tablet, a mobile phone or smart-phone, a wireless-enabled e-reader, or other wireless mobile device. It will be understood that certain components are shown generally, and not all components of such a device are shown in computing device 500.

In some embodiments, computing device 500 includes a first processor 510 that comprises at least one FIVR. The various embodiments of the present disclosure may also comprise a network interface within 570 such as a wireless interface so that a system embodiment may be incorporated into a wireless device, for example, cell phone or personal digital assistant.

In one embodiment, processor 510 can include one or more physical devices, such as microprocessors, application processors, microcontrollers, programmable logic devices, or other processing means. The processing operations performed by processor 510 include the execution of an operating platform or operating system on which applications and/or device functions are executed. The processing operations include operations related to I/O (input/output) with a human user or with other devices, operations related to power management, and/or operations related to connecting the computing device 500 to another device. The processing operations may also include operations related to audio I/O and/or display I/O.

In one embodiment, computing device 500 includes audio subsystem 520, which represents hardware (e.g., audio hardware and audio circuits) and software (e.g., drivers, codecs) components associated with providing audio functions to the computing device. Audio functions can include speaker and/or headphone output, as well as microphone input. Devices for such functions can be integrated into computing device 500, or connected to the computing device 500. In one embodiment, a user interacts with the computing device 500 by providing audio commands that are received and processed by processor 510.

Display subsystem 530 represents hardware (e.g., display devices) and software (e.g., drivers) components that provide a visual and/or tactile display for a user to interact with the computing device 500. Display subsystem 530 includes display interface 532 which includes the particular screen or hardware device used to provide a display to a user. In one embodiment, display interface 532 includes logic separate from processor 510 to perform at least some processing related to the display. In one embodiment, display subsystem 530 includes a touch screen (or touch pad) device that provides both output and input to a user.

I/O controller 540 represents hardware devices and software components related to interaction with a user. I/O controller 540 is operable to manage hardware that is part of audio subsystem 520 and/or display subsystem 530. Additionally, I/O controller 540 illustrates a connection point for additional devices that connect to computing device 500 through which a user might interact with the system. For example, devices that can be attached to the computing device 500 might include microphone devices, speaker or stereo systems, video systems or other display devices, keyboard or keypad devices, or other I/O devices for use with specific applications such as card readers or other devices.

As mentioned above, I/O controller 540 can interact with audio subsystem 520 and/or display subsystem 530. For example, input through a microphone or other audio device can provide input or commands for one or more applications or functions of the computing device 500. Additionally, audio output can be provided instead of, or in addition to display output. In another example, if display subsystem 530 includes a touch screen, the display device also acts as an input device, which can be at least partially managed by I/O controller 540. There can also be additional buttons or switches on the computing device 500 to provide I/O functions managed by I/O controller 540.

In one embodiment, I/O controller 540 manages devices such as accelerometers, cameras, light sensors or other environmental sensors, or other hardware that can be included in the computing device 500. The input can be part of direct user interaction, as well as providing environmental input to the system to influence its operations (such as filtering for noise, adjusting displays for brightness detection, applying a flash for a camera, or other features).

In one embodiment, computing device 500 includes power management 550 that manages battery power usage, charging of the battery, and features related to power saving operation. Memory subsystem 560 includes memory devices for storing information in computing device 500. Memory can include nonvolatile (state does not change if power to the memory device is interrupted) and/or volatile (state is indeterminate if power to the memory device is interrupted) memory devices. Memory subsystem 560 can store application data, user data, music, photos, documents, or other data, as well as system data (whether long-term or temporary) related to the execution of the applications and functions of the computing device 500.

Elements of embodiments are also provided as a machine-readable medium (e.g., memory 560) for storing the computer-executable instructions. The machine-readable medium (e.g., memory 560) may include, but is not limited to, flash memory, optical disks, CD-ROMs, DVD ROMs, RAMs, EPROMs, EEPROMs, magnetic or optical cards, phase change memory (PCM), or other types of machine-readable media suitable for storing electronic or computer-executable instructions. For example, embodiments of the disclosure may be downloaded as a computer program (e.g., BIOS) which may be transferred from a remote computer (e.g., a server) to a requesting computer (e.g., a client) by way of data signals via a communication link (e.g., a modem or network connection).

Connectivity via network interface 570 includes hardware devices (e.g., wireless and/or wired connectors and communication hardware) and software components (e.g., drivers, protocol stacks) to enable the computing device 500 to communicate with external devices. The computing device 500 could be separate devices, such as other computing devices, wireless access points or base stations, as well as peripherals such as headsets, printers, or other devices.

Network interface 570 can include multiple different types of connectivity. To generalize, the computing device 500 is illustrated with cellular connectivity 572 and wireless connectivity 574. Cellular connectivity 572 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, or other cellular service standards. Wireless connectivity (or wireless interface) 574 refers to wireless connectivity that is not cellular, and can include personal area networks (such as Bluetooth, Near Field, etc.), local area networks (such as Wi-Fi), and/or wide area networks (such as WiMax), or other wireless communication.

Peripheral connections 580 include hardware interfaces and connectors, as well as software components (e.g., drivers, protocol stacks) to make peripheral connections. It will be understood that the computing device 500 could both be a peripheral device ("to" 582) to other computing devices, as well as have peripheral devices ("from" 584) connected to it. The computing device 500 commonly has a "docking" connector to connect to other computing devices for purposes such as managing (e.g., downloading and/or uploading, changing, synchronizing) content on computing device 500. Additionally, a docking connector can allow computing device 500 to connect to certain peripherals that allow the computing device 500 to control content output, for example, to audiovisual or other systems.

In addition to a proprietary docking connector or other proprietary connection hardware, the computing device 500 can make peripheral connections 580 via common or standards-based connectors. Common types can include a Universal Serial Bus (USB) connector (which can include any of a number of different hardware interfaces), DisplayPort including MiniDisplayPort (MDP), High Definition Multimedia Interface (HDMI), Firewire, or other types.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is only one of the elements. If the specification or claims refer to "an additional" element, that does not preclude there being more than one of the additional element.

Furthermore, the particular features, structures, functions, or characteristics may be combined in any suitable manner in one or more embodiments. For example, a first embodiment may be combined with a second embodiment anywhere the particular features, structures, functions, or characteristics associated with the two embodiments are not mutually exclusive.

While the disclosure has been described in conjunction with specific embodiments thereof, many alternatives, modifications and variations of such embodiments will be apparent to those of ordinary skill in the art in light of the foregoing description. The embodiments of the disclosure are intended to embrace all such alternatives, modifications, and variations as to fall within the broad scope of the appended claims.

In addition, well known power/ground connections to integrated circuit (IC) chips and other components may or may not be shown within the presented figures, for simplicity of illustration and discussion, and so as not to obscure the disclosure. Further, arrangements may be shown in block diagram form in order to avoid obscuring the disclosure, and also in view of the fact that specifics with respect to implementation of such block diagram arrangements are highly dependent upon the platform within which the present disclosure is to be implemented (i.e., such specifics should be well within purview of one skilled in the art). Where specific details (e.g., circuits) are set forth in order to describe example embodiments of the disclosure, it should be apparent to one skilled in the art that the disclosure can be practiced without, or with variation of, these specific details. The description is thus to be regarded as illustrative instead of limiting.

An abstract is provided that will allow the reader to ascertain the nature and gist of the technical disclosure. The abstract is submitted with the understanding that it will not be used to limit the scope or meaning of the claims. The following claims are hereby incorporated into the detailed description, with each claim standing on its own as a separate embodiment.

We claim:

1. An integrated circuit (IC) die package, comprising:

a package core comprising glass with one or more conductive vias extending from a first side of the core to a second side of the core, opposite the first side;

a first inductor structure over the first side of the package core and a second inductor structure over the second side of the package core, wherein each of the first and second inductor structures comprises:

a conductive trace over the package core;

a dielectric over the conductive trace, wherein the dielectric has a convex curved surface that spans at least a width of the conductive trace; and a magnetic cladding comprising a stack of films over the convex curved surface of the dielectric and at least partially surrounding the conductive trace, wherein a thickness of the dielectric between the magnetic cladding and the conductive trace varies from a center to an outer edge of the inductor structure as a function of the convex curved surface; and a top-level conductive structure over at least one of the first or second inductor structures; where the top-level conductive structure is to interconnect the conductive trace with an IC die.

2. The integrated circuit (IC) die package of claim 1, wherein the convex curved surface has a semicircular profile.

3. The integrated circuit (IC) die package of claim 1, wherein:

the glass comprises at least one of sodium, calcium, or boron.

4. The integrated circuit (IC) die package of claim 1, wherein the package core has an average surface roughness of 100 nm, or less.

5. The integrated circuit (IC) die package of claim 1, wherein the magnetic core cladding comprises a first cladding curved over the convex surface of the dielectric and a planar second cladding between the package core and the conductive traces.

6. The integrated circuit (IC) die package of claim 1, wherein the magnetic cladding has a thickness of less than 3 microns.

7. The integrated circuit (IC) die package of claim 1, wherein individual ones of the films have a thickness no more than 200 nm.

8. The integrated circuit (IC) die package of claim 1, wherein the conductive trace is one of a plurality of coplanar conductive traces, and wherein the conductive traces have substantially the same thickness.

9. The integrated circuit (IC) die package of claim 8, wherein individual ones of the conductive traces all have a thickness of at least 10 microns.

10. The integrated circuit (IC) die package of claim 1, wherein the dielectric is a first dielectric, wherein the stack of films comprises a first film and a second film over the first film, and wherein the first film comprises a magnetic material and the second film comprises a second dielectric.

11. The integrated circuit (IC) die package of claim 10, wherein the second film is a dielectric film, and wherein the second film comprises a magnetic material.

12. The integrated circuit (IC) die package of claim 10, wherein the stack of films comprises multiple alternating layers of the first film and the second film.

13. The integrated circuit (IC) die package of claim 10, wherein the magnetic material comprises at least one of iron, nickel, cobalt, molybdenum, manganese, copper, vanadium, indium, aluminum, gallium, silicon, germanium, tin, antimony, zirconium, tantalum, cobalt-zirconium-tantalum alloy, Mu metal, permalloy, ferrites, Heusler compounds, neodymium, samarium, ytterbium, gadolinium, terbium, or dysprosium.

14. The integrated circuit (IC) die package of claim 10, wherein the first dielectric is a photo imageable material.

15. The integrated circuit (IC) die package of claim 10, wherein the second dielectric comprises at least one of aluminum, titanium, tantalum, molybdenum, silicon, nitrogen or oxygen.

16. A system, comprising:

an integrated circuit (IC) die package, comprising:

a package core comprising glass with one or more conductive vias extending from a first side of the core to a second side of the core, opposite the first side;

an IC die over the first side of the package core;

a first inductor over the first side of the package core and a second inductor over the second side of the package core, wherein each of the first and second inductors comprise:

a conductive trace over the package core;

a dielectric over the conductive trace, wherein the dielectric has a convex curved surface that spans a width of the conductive trace; and a magnetic core cladding comprising a stack of films over the convex curved surface of the dielectric and at least partially surrounding the conductive trace, wherein a thickness of the dielectric between the magnetic cladding and the conductive trace varies from a center to an outer edge of the inductor as a function of the convex curved surface; and wherein the IC die is coupled to at least one of the conductive traces through a top-level conductive structure between the IC die and the first inductor.

17. The system of claim 16, wherein the IC die comprises an integrated voltage regulator circuit coupled to at least one of the first and second inductors.

18. The system of claim 16, wherein the IC die comprises a radio frequency (rf) circuit coupled to at least one of the inductors.

* * * * *